US008317543B2

(12) United States Patent
Tagawa et al.

(10) Patent No.: US 8,317,543 B2
(45) Date of Patent: Nov. 27, 2012

(54) ELECTRICAL CONNECTOR

(75) Inventors: Tetsuya Tagawa, Tokyo (JP); Hiroharu Ikari, Tokyo (JP)

(73) Assignee: Dai-Ichi Seiko Co., Ltd. (JP)

( * ) Notice: Subject to any disclaimer, the term of this patent is extended or adjusted under 35 U.S.C. 154(b) by 0 days.

(21) Appl. No.: 13/062,927

(22) PCT Filed: Oct. 27, 2008

(86) PCT No.: PCT/JP2008/069467

§ 371 (c)(1),
(2), (4) Date: Mar. 8, 2011

(87) PCT Pub. No.: WO2010/032341

PCT Pub. Date: Mar. 25, 2010

(65) Prior Publication Data

US 2011/0165790 A1 Jul. 7, 2011

(30) Foreign Application Priority Data

Sep. 19, 2008 (JP) ..... 2008-240640

(51) Int. Cl.
*H01R 13/648* (2006.01)

(52) U.S. Cl. ..... 439/607.36; 439/374

(58) Field of Classification Search .. 439/607.35–607.4, 439/374

See application file for complete search history.

(56) References Cited

U.S. PATENT DOCUMENTS

2006/0189199 A1* 8/2006 Lang et al. ..... 439/374
2006/0258218 A1* 11/2006 Chen ..... 439/607

FOREIGN PATENT DOCUMENTS

JP 2001-223057 A 8/2001
JP 2002-093528 A 3/2002
JP 2002-164116 A 6/2002
JP 2007-179942 A 7/2007
JP 2008-112700 A 5/2008

OTHER PUBLICATIONS

International Search Report; PCT/JP2008/069467; Nov. 25, 2008.

* cited by examiner

*Primary Examiner* — Gary F. Paumen
(74) *Attorney, Agent, or Firm* — Studebaker & Brackett PC; Donald R. Studebaker

(57) ABSTRACT

An electrical connector which comprises an insulated housing on which a first engaging portion is provided for engaging with a second engaging portion provided in a mating electrical connector, first contacts arranged in a predetermined direction on the insulated housing and operative to come into contact with second contacts provided in the mating electrical connector, a conductive shell for covering partially the insulated housing, and an aligning cover attached to the conductive shell and operative to cause end portions thereof in the predetermined direction to engage respectively with end portions in the predetermined direction of the mating electrical connector for aligning the insulated housing with the mating electrical connector when the first engaging portion is engaged with the second engaging portion, and with which the first engaging portion can be appropriately and smoothly put in engagement with the second engaging portion.

5 Claims, 21 Drawing Sheets

ELECTRICAL CONNECTOR

TECHNICAL FIELD

The present invention relates to an electrical connector with which a bundle of cables, a flexible printed circuit board (FPC) or the like is connected and which is put in engagement with a mating electrical connector fixed to a main circuit board, such as a solid printed circuit board, to be operative to connect electrically the cables, the FPC or the like with the mating connector.

TECHNICAL BACKGROUND

When a bundle of relatively slender cables or a relatively small-sized FPC is electrically connected with a main circuit board, such as a solid printed circuit board, on which various electrical parts are directly mounted, there has been often proposed to use a first electrical connector on the side of cables or FPC, with which the bundle of cables or the FPC is connected, and a second electrical connector on the side of circuit board, which is fixed to a main circuit board to be electrically connected with the same and with which the first electrical connector is engaged. The first electrical connector is operative to function as a mating electrical connector to the second electrical connector and the second electrical connector is operative to function as a mating electrical connector to the first electrical connector.

In such a case, the first electrical connector constitutes a plug type electrical connector which comprises, for example, an insulated housing which is provided thereon with an engaging portion forming a connectively engaging protrusion on which a plurality of conductive contacts are arranged to be electrically connected with the cables or the FPC. Usually, the first electrical connector constituting the plug type electrical connector comprises also a conductive shell or cover formed by means of processing a metal thin plate and mounted on the insulated housing for covering partially the same to be grounded for shielding the conductive contacts arranged on the connectively engaging protrusion provided on the insulated housing from electromagnetic wave noise coming from the outside. The second electrical connector operative to function as the mating electrical connector to the first electrical connector constitutes a receptacle type electrical connector which comprises, for example, an insulated housing on which an engaging portion forming a connectively engaging opening into which the connectively engaging protrusion provided on the insulated housing of the first electrical connector is inserted is provided. In the connectively engaging opening provided on the insulated housing of the second electrical connector, portions of a plurality of conductive contacts, an end of each of which constitutes a terminal connected electrically with the main circuit board, are arranged. Usually, the second electrical connector constituting the receptacle type electrical connector comprises also a conductive shell or cover formed by means of processing a metal thin plate and mounted on the insulated housing for covering partially the same to be grounded for shielding the conductive contacts arranged in the insulated housing from electromagnetic wave noise coming from the outside. Under such a situation, when the connectively engaging protrusion provided on the insulating housing of the first electrical connector is inserted into the connectively engaging opening provided on the insulated housing of the second electrical connector to engage with the same, the conductive contacts of the first electrical connector come into contact respectively with the conductive contacts of the second electrical connector to be connected electrically with the same.

With the above-described first electrical connector constituting the plug type electrical connector with which the bundle of cables or the FPC is connected and the second electrical connector constituting the receptacle type electrical connector fixed to the main circuit board, when the connectively engaging protrusion provided on the insulated housing of the first electrical connector with which the bundle of cables or the FPC is connected is engaged with the connectively engaging opening provided on the insulating housing of the second electrical connector which is fixed to the main circuit board, it is required for a set of the first and second electrical connectors put in engagement with each other to have a size reduced to be as small as possible in an altitudinal direction on the main circuit board so as to reduce an open space surrounding the main circuit board. For meeting such a requirement, the second electrical connector constituting the receptacle type electrical connector is fixed to the main circuit board in such a manner that the connectively engaging opening is made open in a direction in parallel with an outer surface of the main circuit board and the first electrical connector constituting the plug type electrical connector is moved along the direction in parallel with the outer surface of the main circuit board for causing the connectively engaging protrusion to engage with the connectively engaging opening in the second electrical connector.

When the connectively engaging protrusion provided on the insulated housing of the first electrical connector constituting the plug type electrical connector is engaged with the connectively engaging opening provided on the insulated housing of the second electrical connector constituting the receptacle type electrical connector in such a manner as mentioned above, it is required that first the connectively engaging protrusion is set to face the connectively engaging opening at an appropriate position in an appropriate direction and then the connectively engaging protrusion thus set is moved appropriately to the connectively engaging opening so as to engage with the same. Accordingly, there have been previously proposed some measures or means for meeting the requirements for the connectively engaging protrusion provided on the insulated housing of the first electrical connector constituting the plug type electrical connector. In one of such measures or means proposed previously, the first electrical connector constituting the plug type electrical connector is provided with an engaging guide member for projecting to the outside of the connectively engaging protrusion and the second electrical connector constituting the receptacle type electrical connector is provided with an engaging receptacle opening for engaging with the engaging guide member to receive the same. When the connectively engaging protrusion provided on the first electrical connector is put in engagement with the connectively engaging opening provided on the second electrical connector, prior to the engagement of the connectively engaging protrusion with the connectively engaging opening, the engaging guide member provided on the first electrical connector is engaged with the engaging receptacle opening provided on the second electrical connector to be received by the same so that a position at which the connectively engaging protrusion faces the connectively engaging opening and a direction along which the connectively engaging protrusion is moved to the connectively engaging opening are predetermined and thereby the connectively engaging protrusion is set to face the connectively engaging opening at the appropriate position in the appropriate direction and then the connectively engaging protrusion thus set is moved appropriately to the connectively engaging opening so as to engage with the same. (As disclosed in, for example, patent document 1.)

In such a pair of first and second electrical connectors to which the previously proposed measure or means is applied, as shown in the patent document 1 published previously, a first electrical connector constituting a plug type electrical connector (a plug 20) is provided with a connectively engaging protrusion which forms a plurality of protecting tongues (34) on an insulated housing (a housing 21) and on which a plurality of contacting portions (24) are arranged and a pair of engaging guide members (engaging arms 30) which faces each other with the connectively engaging protrusion between and projects to the outside of the connectively engaging protrusion and an insulated housing (a housing 71) of a second electrical connector constituting a plug type electrical connector (a receptacle 70) is provided with a connectively engaging opening (a engaging groove 80), with which the connectively engaging protrusion of the first electrical connector is engaged, and a pair of engaging receptacle openings (79) which are opposite to each other with the connectively engaging opening between and with which the engaging guide members of the first electrical connector are engaged, respectively. When the connectively engaging protrusion of the first electrical connector is put in engagement with the connectively engaging opening of the second electrical connector, first the engaging guide members of the first electrical connector are engaged respectively with the engaging receptacle openings of the second electrical connector so that the first electrical connector is guided to the second electrical connector by the engaging guide members and the engaging receptacle openings, and then the connectively engaging protrusion of the first electrical connector is engaged with the connectively engaging opening of the second electrical connector.

Further, there has been also proposed previously a pair of electrical connectors (first and second electrical connectors) wherein conductive contacts provided in the first electrical connector are put respectively in contact with conductive contacts provided in the second electrical connector. In such first and second electrical connectors, when the conductive contacts provided in the first electrical connector come respectively into contact with conductive contacts provided in the second electrical connector, a guiding projection (an engaging guide member) provided in the first electrical connector is engaged with a guiding opening (an engaging receptacle opening) provided in the second electrical connector. (As disclosed in, for example, patent document 2.)

In the first and second electrical connectors disclosed in the patent document 2 published previously, prior to the contact of the conductive contacts provided in the first electrical connector with the conductive contacts provided in the second electrical connector, the guiding projection constituting the engaging guide member of the first electrical connector is caused to engage with the guiding opening constituting the engaging receptacle opening of the second electrical connector to be received by the same so that a position at which the first electrical connector faces the second electrical connector and a direction along which the first electrical connector is moved to the second electrical connector are predetermined.

Patent document 1: Japanese Patent Publication No. 2002-93528 (Pages 3 to 5, FIG. 1)

Patent document 2: Japanese Patent Publication No. 2001-223057 (Pages 3 and 4, FIGS. 1, 2 and 4)

DISCLOSURE OF THE INVENTION

Problems Intended to be Solved by the Invention

In the previously proposed first and second electrical connectors mentioned above, the engagement of the connectively engaging protrusion of the first electrical connector with the connectively engaging opening of the second electrical connector or the contact of the conductive contacts of the first electrical connector with the conductive contacts of the second electrical connector is carried out under a condition wherein the engaging guide member of the first electrical connector is caused to engage with the engaging receptacle opening of the second electrical connector to be received by the same and thereby the first electrical connector is guided to the second electrical connector by the engaging guide member and the engaging receptacle opening so that the position at which the first electrical connector faces the second electrical connector and the direction along which the first electrical connector is moved to the second electrical connector are predetermined. In such a case, after the engaging guide member of the first electrical connector is engaged with the engaging receptacle opening of the second electrical connector, it is expected that the engagement of the connectively engaging protrusion of the first electrical connector with the connectively engaging opening of the second electrical connector or the contact of the conductive contacts of the first electrical connector with the conductive contacts of the second electrical connector is carried out appropriately and smoothly. However, the engaging guide member of the first electrical connector is caused to engage with the engaging receptacle opening of the second electrical connector to be received by the same under a condition wherein the first electrical connector is not subjected to any guidance to the second electrical connector and therefore it is not guaranteed that the engagement of the engaging guide member with the engaging receptacle opening is carried out smoothly.

That is, in the above-described previously proposed first and second electrical connectors, although it is intended to obtain a situation wherein the engagement of the connectively engaging protrusion of the first electrical connector with the connectively engaging opening of the second electrical connector or the contact of the conductive contacts of the first electrical connector with the conductive contacts of the second electrical connector is carried out appropriately and smoothly by means of causing the engaging guide member of the first electrical connector to engage with the engaging receptacle opening of the second electrical connector, it is difficult practically to obtain such a situation as mentioned above easily and smoothly.

Accordingly, it is an object of the present invention to provide an electrical connector which has an insulated housing provided thereon with an engaging portion on which a plurality of contacting terminals of conductive contacts are arranged and which is put in engagement with an engaging portion provided in a mating electrical connector for causing the contacting terminals of the conductive contacts to come into contact with conductive contacts arranged in the mating electrical connector to be electrically connected with the same, and with which a situation wherein the engagement of the engaging portion provided on the insulated housing with the engaging portion provided in the mating electrical connector is carried out appropriately and smoothly can be obtained easily and smoothly.

Approach to Solve the Problems

According to the present invention, there is provided an electrical connector, which comprises an insulated housing on which a first engaging portion is provided for engaging with a second engaging portion provided in a mating electrical connector, a plurality of first conductive contacts provided on the insulated housing with contacting terminals thereof arranged along a predetermined direction on the first engaging portion and operative to come into contact with a plurality of second conductive contacts provided in the mating electrical connector when the first engaging portion is put in engagement with the second engaging portion, a conductive shell for covering partially the insulated housing, and an aligning cover attached to the conductive shell for covering partially an outside surface of the conductive shell and operative to cause a pair of end portions thereof in a direction along which the contacting terminals of the first conductive contacts are arranged (hereinafter, referred to as a terminal arrangement direction) to engage respectively with a pair of end portions in the terminal arrangement direction of the mating electrical connector for aligning the insulated housing with the mating electrical connector to be restricted in position and moving direction when the first engaging portion is engaged with the second engaging portion.

Especially, in a first example of the electrical connector according to the present invention, each of the end portions in the terminal arrangement direction of the aligning cover is provided with a first guiding member facing an end surface in the terminal arrangement direction of the insulated housing with a predetermined space between and a second guiding member apart from the first guiding member on the side of the first engaging portion, and each of the first and second guiding members is operative to engage with the end portion of the mating electrical connector when the first engaging portion is engaged with the second engaging portion.

Further, in a second example of the electrical connector according to the present invention, each of the first and second guiding members provided on each of the end portions in the terminal arrangement direction of the aligning cover extends to be bent from a portion of the aligning cover expanding over the outside surface of the conductive shell to approach the end surface in the terminal arrangement direction of the insulated housing.

With the electrical connector thus constituted in accordance with the present invention, when the first engaging portion provided on the insulated housing is put in engagement with the second engaging portion provided in the mating electrical connector, prior to the engagement of the first engaging portion with the second engaging portion, the aligning cover which is attached to the conductive shell covering partially the insulated housing causes the end portions thereof in the terminal arrangement direction to engage respectively with the end portions in the terminal arrangement direction of the mating electrical connector for aligning the insulated housing with the mating electrical connector to be restricted in position and moving direction. Therefore, a position at which the first engaging portion provided on the insulated housing faces the second engaging portion provided in the mating connector and a direction along which the first engaging portion is moved to the second engaging portion are predetermined. Then, the first engaging portion provided on the insulated housing facing the second engaging portion provided in the mating connector at the predetermined position is moved to the second engaging portion along the predetermined direction so as to be engaged with the second engaging portion.

The aligning cover functioning as described above is provided, for example, on each of the end portions thereof in the terminal arrangement direction, with the first and second guiding members, as those employed in the first example of the electrical connector according to the present invention. The first and second guiding members are formed, for example, to extend to be bent from the portion of the aligning cover expanding over the outside surface of the conductive shell to approach the end surface in the terminal arrangement direction of the insulated housing, as those employed in the second example of the electrical connector according to the present invention. In such a condition, for example, the first guiding member is positioned to face the end surface of the insulated housing with the predetermined space between, the second guiding member is positioned to be apart from the first guiding member on the side of the first engaging portion provided on the insulated housing, and each of the first and second guiding members is operative to engage with the end portion of the mating electrical connector when the first engaging portion is engaged with the second engaging portion provided in the mating electrical connector.

Thereby, when the first engaging portion provided on the insulated housing is put in engagement with the second engaging portion provided in the mating electrical connector, first the second guiding member comes to engagement with a first contacting portion provided on the end portion in the terminal arrangement direction of the mating electrical connector for guiding the insulated housing toward the mating electrical connector and then the first guiding member comes to engagement with a second contacting portion provided on the end portion in the terminal arrangement direction of the mating electrical connector for facing the end surface of the insulated housing with the second contacting portion between and guiding further the insulated housing toward the mating electrical connector. Thereafter, the engagement of the first engaging portion provided on the insulated housing with the second engaging portion provided in the mating electrical connector is completed under the condition wherein the insulated housing is guided to the mating electrical connector by the aligning cover.

When the engagement of the first engaging portion provided on the insulated housing with the second engaging portion provided in the mating electrical connector is completed, for example, each of the end portions in the terminal arrangement direction of the aligning cover faces a part of the outside surface of the conductive shell with a part of the end portion in the terminal arrangement direction of the mating electrical connector in a direction perpendicular to the terminal arrangement direction.

Effect and Advantages of the Invention

With the electrical connector according to the present invention mentioned above, when the first engaging portion provided on the insulated housing is put in engagement with the second engaging portion provided in the mating electrical connector, prior to the engagement of the first engaging portion with the second engaging portion, the insulated housing is aligned with the mating electrical connector to be restricted in its position and its moving direction by the aligning cover which is attached to the conductive shell covering partially the insulated housing so as to cover partially the outside surface of the same, so that the position at which the first engaging portion faces the second engaging portion and the direction along which the first engaging portion is moved to the second engaging portion are predetermined. Therefore, when the first engaging portion on which the contacting terminals of the first conductive contacts are arranged is put in engagement with the second engaging portion provided in the mating electrical connector so that the contacting terminals of the first conductive contacts come into contact with the second conductive contacts provided in the mating electrical connector to be electrically connected with the same, a situation wherein the engagement of the first engaging portion with the second engaging provided is carried out appropriately and smoothly can be obtained easily and smoothly.

Especially, with each of the first and second examples of the electrical connector according to the present invention, the aligning cover is provided on each of the end portions thereof in the terminal arrangement direction with the first guiding member facing the end surface in the terminal arrangement direction of the insulated housing with the predetermined space between and the second guiding member apart from the first guiding member on the side of the first engaging portion provided on the insulated housing. When the first engaging portion is put in engagement with the second engaging portion provided in the mating electrical connector, first the second guiding member comes to engagement with the first contacting portion provided on the end portion in the terminal arrangement direction of the mating electrical connector for guiding the insulated housing toward the mating electrical connector, then the first guiding member comes to engagement with the second contacting portion provided on the end portion in the terminal arrangement direction of the mating electrical connector for facing the end surface of the insulated housing with the second contacting portion between and guiding further the insulated housing toward the mating electrical connector, and thereafter, the engagement of the first engaging portion with the second engaging portion is completed with the guidance by the first and second guiding members. Therefore, the situation wherein the engagement of the first engaging portion with the second engaging provided is carried out appropriately and smoothly can be obtained surely, more easily and more smoothly.

Further, in the case where each of the end portions in the terminal arrangement direction of the aligning cover faces the part of the outside surface of the conductive shell with the part of the end portion in the terminal arrangement direction of the mating electrical connector in the direction perpendicular to the terminal arrangement direction when the engagement of the first engaging portion provided on the insulated housing with the second engaging portion provided in the mating electrical connector is completed, a disadvantage that a part of the first engaging portion is minutely swung undesirably in the terminal arrangement direction when the first engaging portion is caused to get out of the second engaging portion can be surely avoided.

DESCRIPTION OF REFERENCES IN THE DRAWINGS

Figure 1:
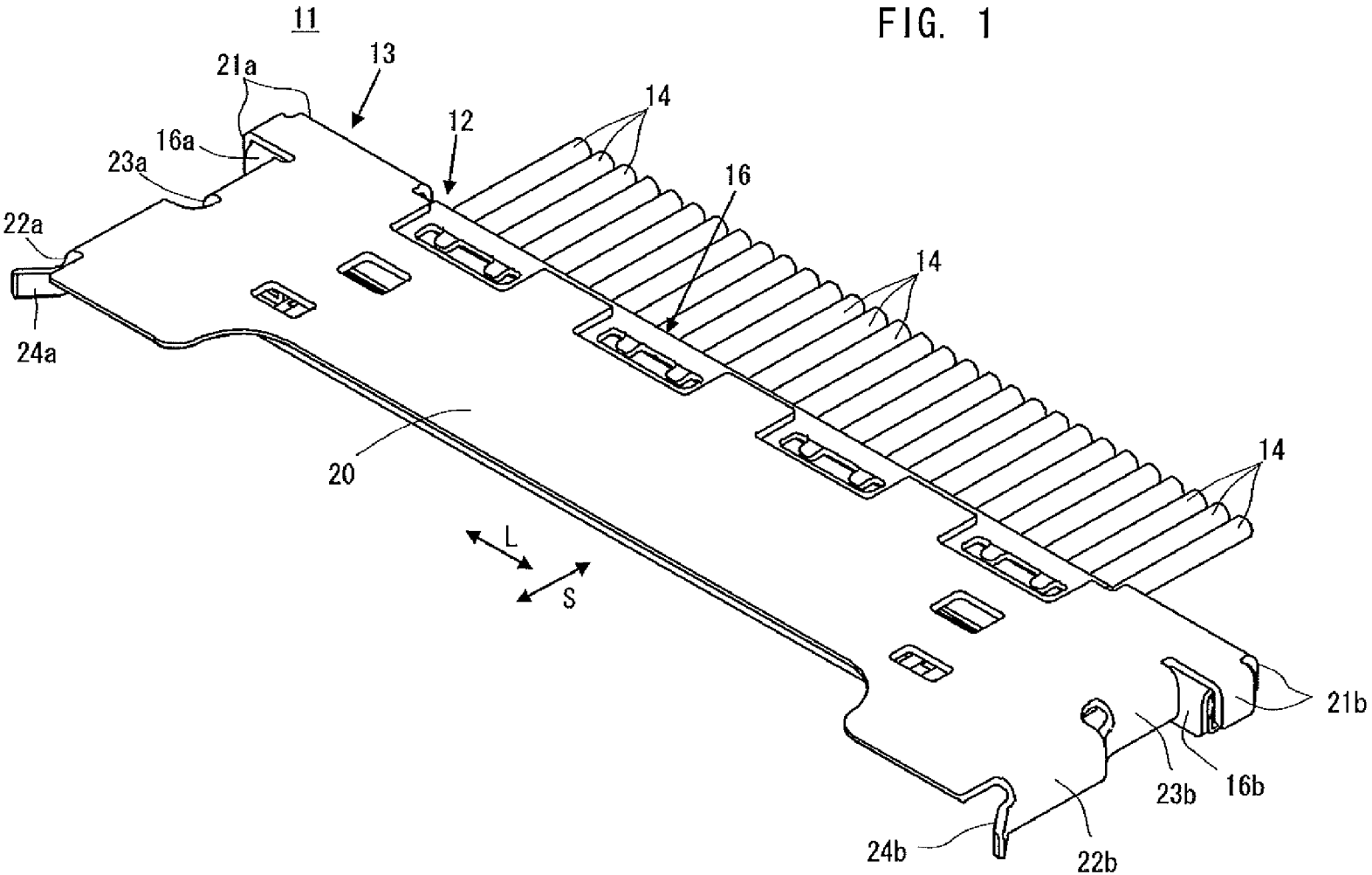
FIG. 1 is a schematic perspective view showing an embodiment of electrical connector according to the present invention and a plurality of cables connected with the embodiment.

11 . . . electrical connector, 12 . . . body (of electrical connector 11), 13 . . . aligning cover, 14 . . . coaxial cable, 15, 31 . . . insulated housing, 16, 32 . . . conductive shell, 16*a*, 16*b* . . . end portion (of conductive shell 16), 16*c*,16*d* . . .

engaging projection, 17 . . . connectively engaging protrusion, 18, 34 . . . conductive contact, 20 . . . flat plate portion (of aligning cover 13), 21*a*, 21*b* . . . engaging portion, 22*a*, 22*b*, 23*a*, 23*b* . . . guiding member, 24*a*, 24*b* . . . engagement guiding portion, 25*a*, 25*b* . . . end surface (of insulated housing 15), 30 . . . mating electrical connector, 33 . . . connectively engaging opening, 35*a*, 35*b* . . . end portion (of conductive shell 32), 36*a*, 36*b* . . . engaging aperture, 37*a*, 37*b*, 38*a*, 38*b* . . . contacting portion, 39*a*, 39*b* . . . grounding terminal, 40*a*, 40*b* . . . resilient tongue

MODE MOST PREFERABLE FOR WORKING OF THE INVENTION

A mode most preferable for working of the present invention will be explained with an embodiment of electrical connector according to the present invention described below.

Embodiment

Figure 2:
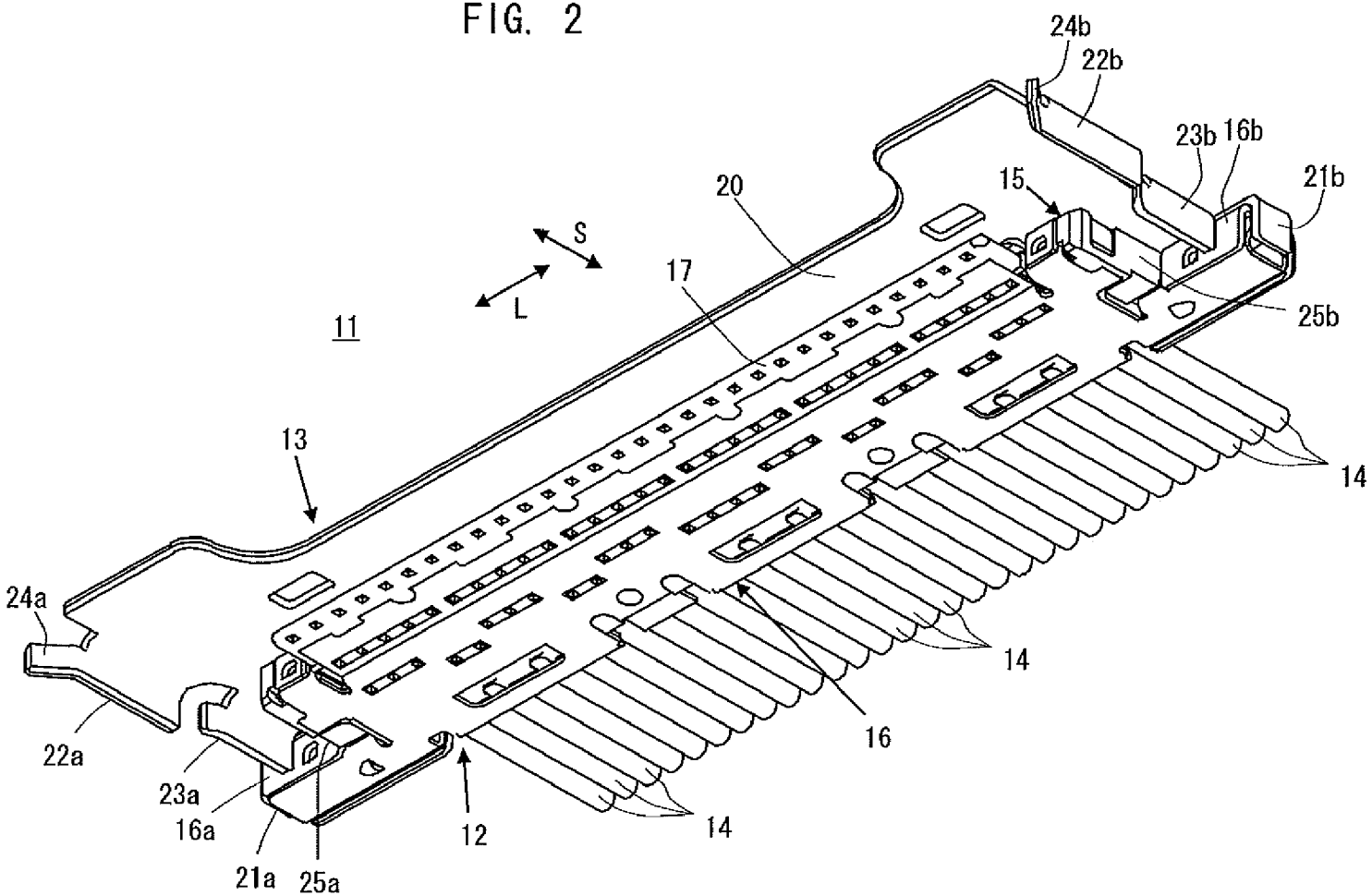
FIG. 2 is a schematic perspective view showing the embodiment of electrical connector according to the present invention and the cables connected with the embodiment.

FIGS. 1 and 2 show an embodiment of electrical connector according to the present invention, together with a plurality of cables connected with the embodiment.

Referring to FIGS. 1 and 2, an electrical connector 11, which constitutes the embodiment of electrical connector according to the present invention, comprises a body 12 and an aligning cover 13 mounted on the body 12. The electrical connector 11 is used as an electrical connector on the side of cables, with the body 12 of which a plurality of coaxial cables 14 are electrically connected, and which is put in engagement with a mating electrical connector constituting an electrical connector on the side of a circuit board, which is fixed to, for example, a solid printed circuit board so as to be connected electrically with an electric circuit portion provided on the solid printed circuit board.

Figure 3:
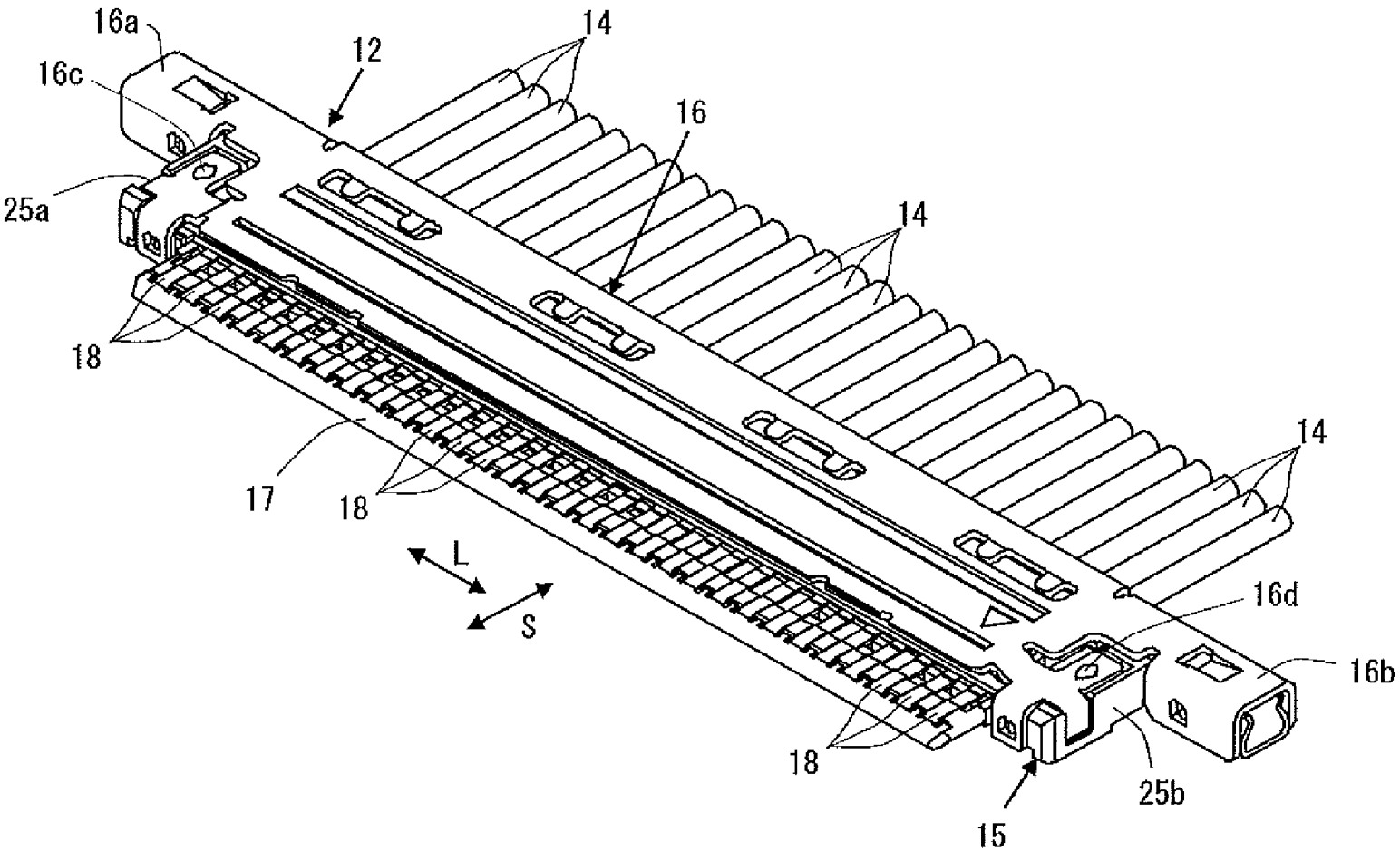
FIG. 3 is a schematic perspective view showing a body of the embodiment shown in FIGS. 1 and 2 and the cables connected with the body.
Figure 4:
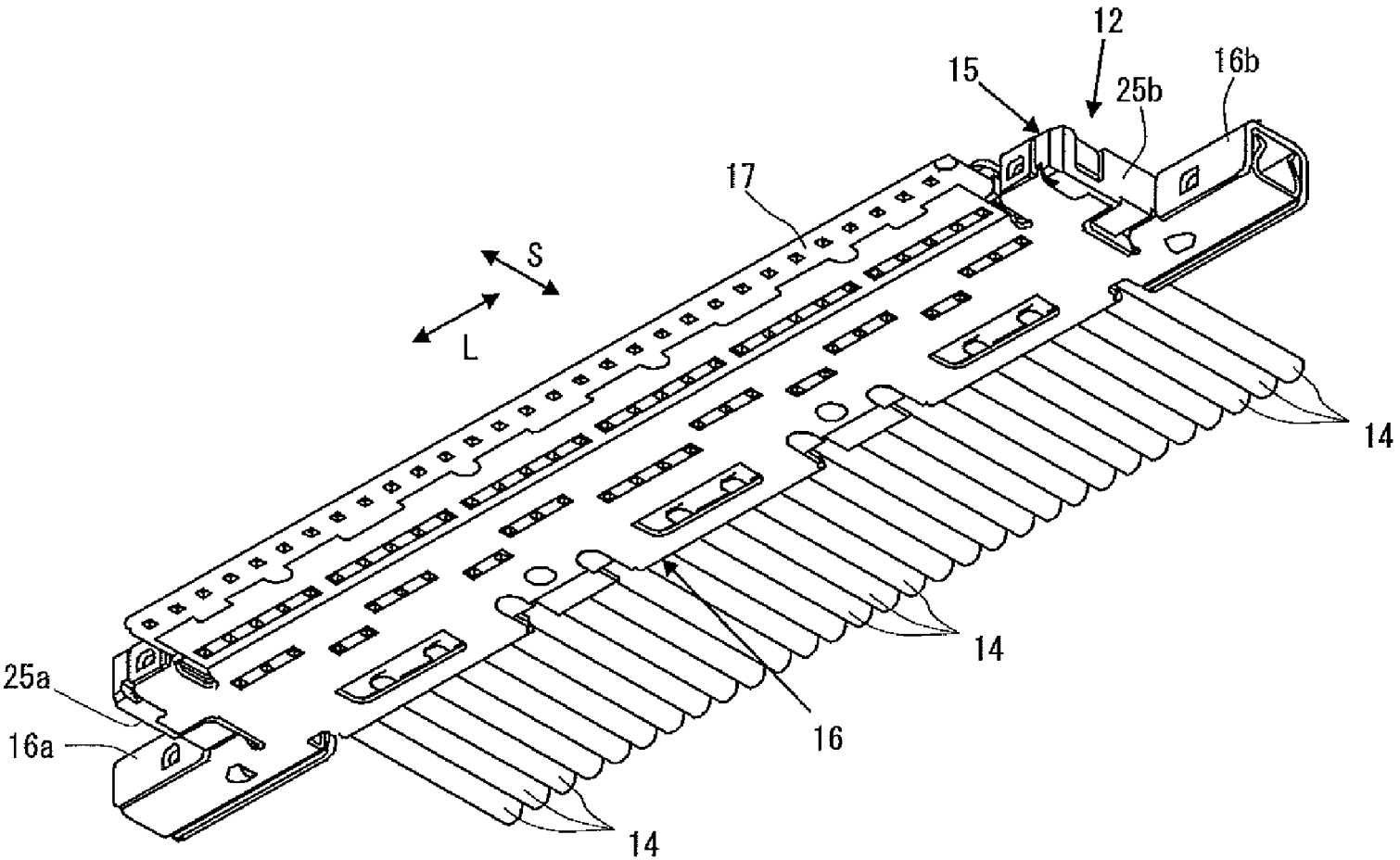
FIG. 4 is a schematic perspective view showing the body of the embodiment shown in FIGS. 1 and 2 and the cables connected with the body.

As shown in FIGS. 3 and 4, the body 12 of the electrical connector 11 comprises an insulated housing 15 made of insulator such as plastics or the like and a conductive shell 16 covering partially an outside surface of the insulated housing 15. The conductive shell 16 is formed by means of processing a resilient metal thin plate and grounded to be operative to shield the body 12 of the electrical connector 11 from electromagnetic wave noises coming from the outside.

The insulated housing 15 is provided thereon with a first engaging portion forming a connectively engaging protrusion 17 which elongates in a longitudinal direction of the insulated housing 15 (which is indicated with arrow L in FIGS. 1 to 6, and hereinafter, referred to an L direction) and is operative to be put in engagement with a second engaging portion forming a connectively engaging opening provided in the mating electrical contact (the electrical connector on the side of a circuit board). Further, the insulated housing 15 is also provided thereon with a plurality of conductive contacts 18 each formed by means of bending a resilient metallic strip member. The conductive contacts 18 have respectively contacting terminals thereof arranged in the L direction on the connectively engaging protrusion 17. That is, the L direction is a terminal arrangement direction along which the contacting terminals of the conductive contacts 18 are arranged.

When the connectively engaging protrusion 17 is put in engagement with the connectively engaging opening provided in the mating electrical contact, the contacting terminal of each of the conductive contacts 18 arranged on the connectively engaging protrusion 17 comes into contact with a corresponding one of a plurality of conductive contacts which are provided in the mating electrical connector to be connected electrically with the solid circuit board to which the mating electrical connector is fixed so that the conductive contacts 18 are respectively in contact with the conductive contacts provided in the mating electrical connector. Further, each of the conductive contacts 18 is connected with a signal conductor of a corresponding one of the coaxial cables 14. Each of the coaxial cables 14 is connected electrically with the body 12 of the electrical connector 11 with the signal conductor thereof connected with the conductive contact 18 and a grounding conductor thereof put in contact with the conductive shell 16.

The conductive shell 16 comprises upper and lower halves which are engaged with each other at end portions in the L direction of each of the upper and lower halves. The upper half of the conductive shell 16 covers partially an outside surface positioned upward in FIG. 1 (hereinafter, referred to as an upper surface) of the insulated housing 15 and the lower half of the conductive shell 16 covers partially an outside surface positioned downward in FIG. 1 (hereinafter, referred to as a lower surface) of the insulated housing 15. That is, each of end portions 16*a* and 16*b* in the L direction of the conductive shell 16 constitutes a portion of the conductive shell 16 at which the upper and lower halves are engaged with each other.

Engaging projections 16*c* and 16*d* are provided on the upper half of the conductive shell 16. The engaging projection 16*c* is located to be in the vicinity of one of the end portions of the upper half of the conductive shell 16 constituting the end portion 16*a* of the conductive shell 16 and operative to engage with an engaging aperture formed in a conductive shell of the mating electrical connector when the connectively engaging protrusion 17 of the insulated housing 15 is engaged with the connectively engaging opening provided in the mating electrical connector. The engaging projection 16*d* is located to be in the vicinity of the other of the end portions of the upper half of the conductive shell 16 constituting the end portion 16*b* of the conductive shell 16 and operative to engage with an engaging aperture formed in the conductive shell of the mating electrical connector when the connectively engaging protrusion 17 of the insulated housing 15 is engaged with the connectively engaging opening provided in the mating electrical connector. Each of the engaging projections 16*c* and 16*d* is formed in a resilient tongue contained in the upper half of the conductive shell 16 to be engaged with and disengaged from the engaging aperture formed in the conductive shell of the mating electrical connector with the resilient tongue deformed resiliently.

Figure 5:
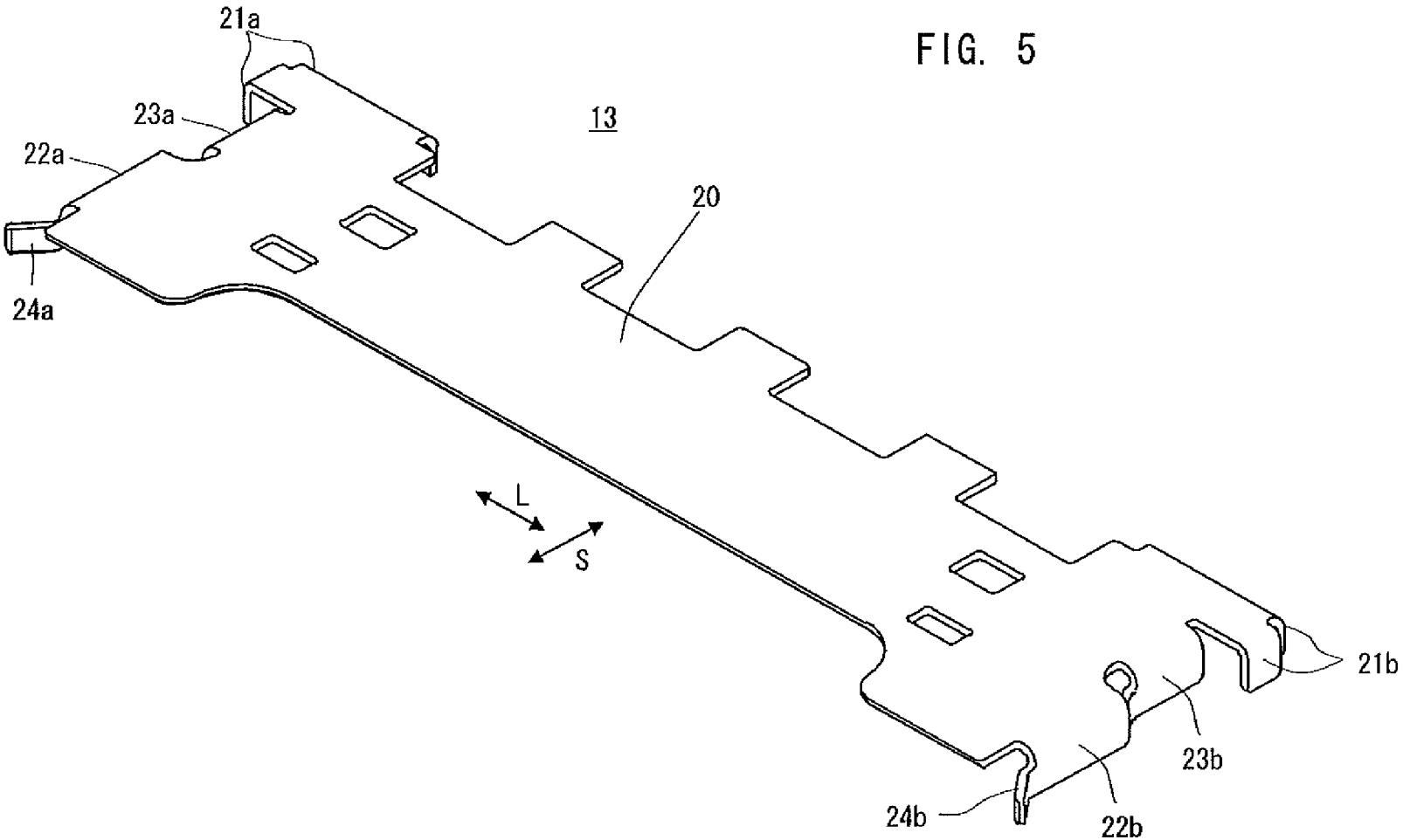
FIG. 5 is a schematic perspective view showing alone an aligning cover constituting the embodiment shown in FIGS. 1 and 2.
Figure 6:
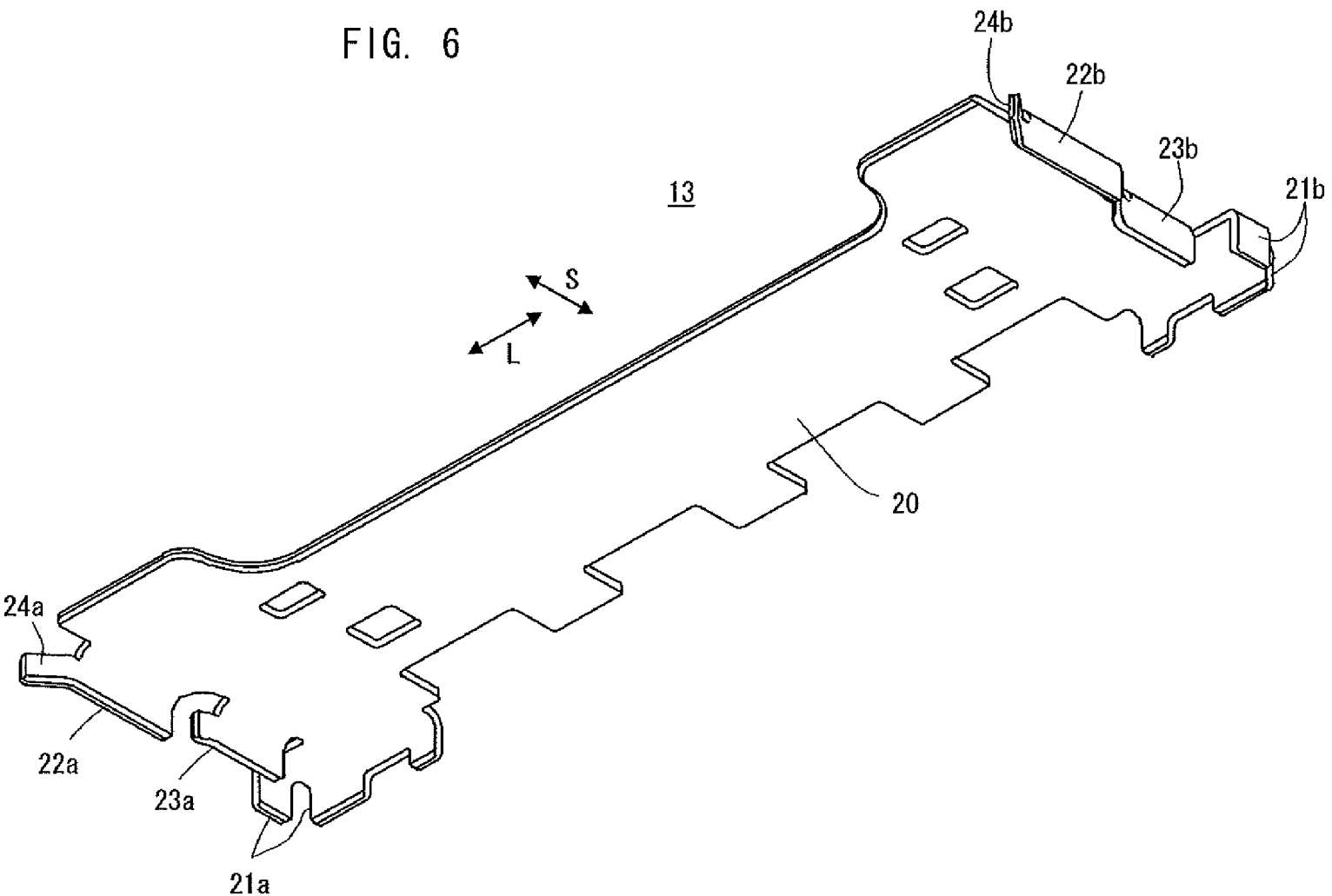
FIG. 6 is a schematic perspective view showing alone the aligning cover constituting the embodiment shown in FIGS. 1 and 2.

The aligning cover 13 is formed, for example, by means of bending a resilient metal thin plate to be attached to the conductive shell 16 of the body 12 of the electrical connector 11 for covering partially an outside surface of the upper half of the conductive shell 16. As shown in FIGS. 5 and 6, the aligning cover 13 has a flat plate portion 20 which covers a major part of the upper half of the conductive shell 16 when the aligning cover 13 is attached to the conductive shell 16. Engaging portions 21*a* and guiding members 22*a* and 23*a* are provided at one of a pair of end portions in the L direction of the flat plate portion 20 of the aligning cover 13 to extend to be bent from the flat plate portion 20 and engaging portions 21*b* and guiding members 22*b* and 23*b* are also provided at the other of the end portions in the L direction of the flat plate portion 20 of the aligning cover 13 to extend to be bent from the flat plate portion 20.

An end portion of the guiding member 22*a* on the side remote from the guiding member 23*a* forms an engagement guiding portion 24*a* which is bent outwardly to have a slanted surface in the L direction and similarly an end portion of the guiding member 22*b* on the side remote from the guiding member 23*b* forms an engagement guiding portion 24*b* which is bent outwardly to have a slanted surface in the L direction. The guiding member 22*a* projects from the flat plate portion 20 outwardly more than the guiding member 23*a* in the L direction and similarly the guiding member 22*b* projects from the flat plate portion 20 outwardly more than the guiding member 23*b* in the L direction.

The aligning cover 13 thus constituted is attached to the conductive shell 16 of the body 12 of the electrical connector 11 shown in FIGS. 3 and 4 in such a manner that the flat plate portion 20 covers the major part of the outside surface of the upper half of the conductive shell 16 and the engaging portions 21*a* and 21*b* engage respectively with the end portions 16*a* and 16*b* of the conductive shell 16. When the aligning cover 13 is attached to the conductive shell 16, it is possible to fix the aligning cover 13 to the body 12 of the electrical connector 11 by means of soldering the aligning cover 13 to the conductive shell 16.

The aligning cover 13 is attached to the conductive shell 16 as described above and thereby the electrical connector 11 shown in FIGS. 1 and 2 is obtained. In the electrical connector 11, the flat plate portion 20 of the aligning cover 13 extends from the upper half of the conductive shell 16 outwardly in a direction perpendicular to the L direction (which is indicated with arrow S in FIGS. 1 to 6, and hereinafter, referred to an S direction) to overhang over an upper surface of the connectively engaging protrusion 17 provided on the insulated housing 15. Further, the flat plate portion 20 of the aligning cover 13 extends from the upper half of the conductive shell 16 outwardly also in the L direction on the side of each of the end portions 16*a* and 16*b* of the conductive shell 16. Therefore, as shown in FIG. 2, the guiding member 23*a* faces an end surface 25*a* in the L direction of the insulated housing 15 with a predetermined space between and the guiding member 22*a* is located apart from the guiding member 23*a* on the side of the connectively engaging protrusion 17 of the insulated housing 15. Similarly, as shown in FIG. 2 also, the guiding member 23*b* faces an end surface 25*b* in the L direction of the insulated housing 15 with a predetermined space between and the guiding member 22*b* is located apart from the guiding member 23*b* on the side of the connectively engaging protrusion 17 of the insulated housing 15.

Incidentally, although the end surfaces 25*a* and 25*b* of the insulated housing 15 are not covered with the conductive shell 16 in the embodiment shown in FIGS. 1 and 2, it is also possible to cover each of the end surfaces 25*a* and 25*b* of the insulated housing 15 with the conductive shell 16.

Figure 7:
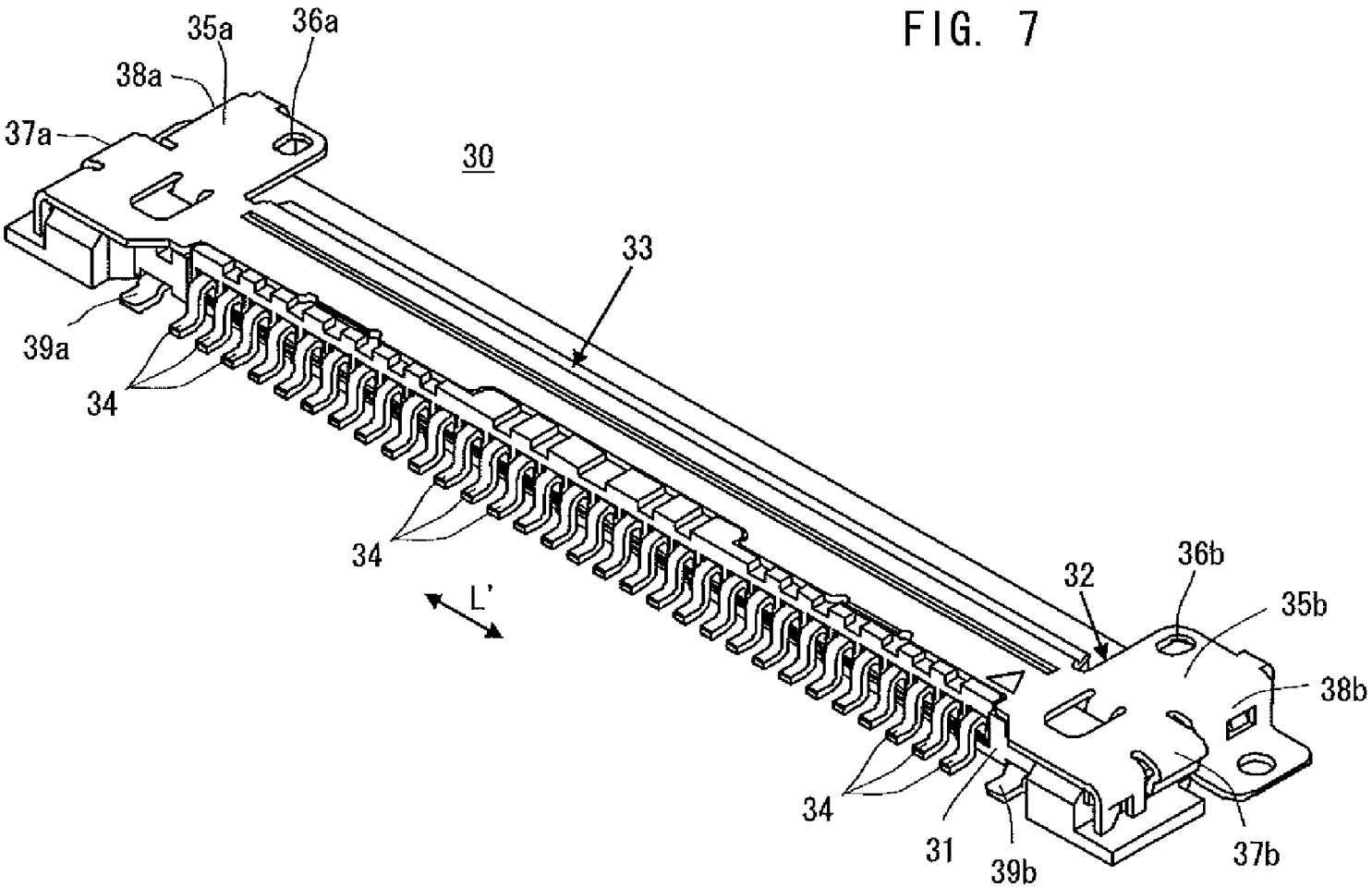
FIG. 7 is a schematic perspective view showing an example of mating electrical connector, with which the embodiment shown in FIGS. 1 and 2 engages.
Figure 8:
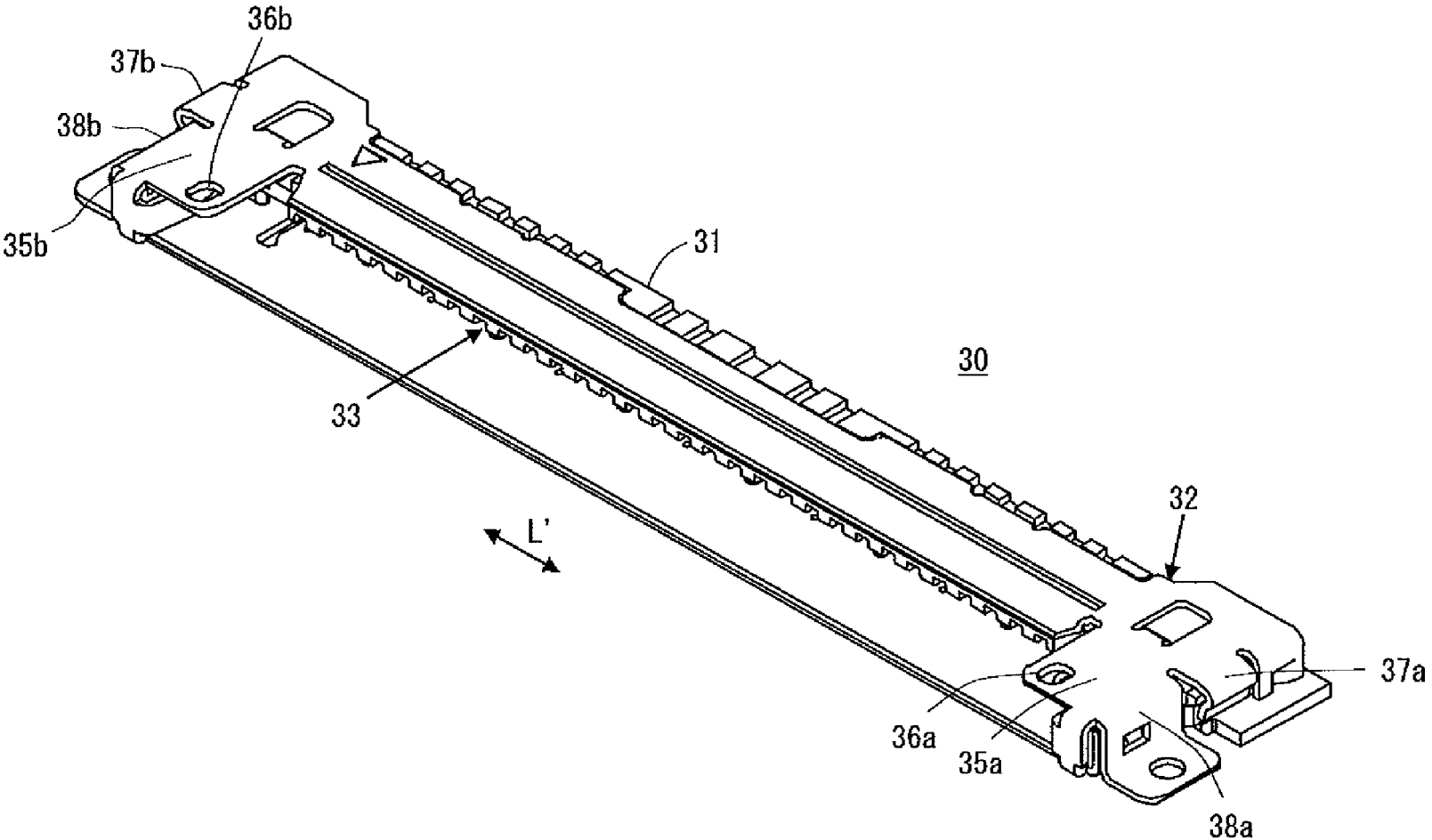
FIG. 8 is a schematic perspective view showing the example of mating electrical connector, with which the embodiment shown in FIGS. 1 and 2 engages.

FIGS. 7 and 8 show a mating electrical connector 30 with which the electrical connector 11 is put in engagement.

Referring to FIGS. 7 and 8, the mating electrical connector 30 is fixed to, for example, the solid printed circuit board to be electrically connected with the electric circuit portion provided on the solid printed circuit board, so that the electrical connector 11 is put in engagement with the mating electrical connector 30 fixed to the solid printed circuit board. The mating electrical connector 30 comprises an insulated housing 31 made of insulator such as plastics or the like and a conductive shell 32 covering a major portion of an outside surface of the insulated housing 31, which is formed by means of bending a resilient metal thin plate and grounded to be operative to shield the mating electrical connector 30 from electromagnetic wave noises coming from the outside.

On the insulated housing 31 and the conductive shell 32, a second engaging portion forming a connectively engaging opening 33 is provided to extend in a longitudinal direction of the insulated housing 31 (which is indicated with arrow L' in FIGS. 7 and 8, and hereinafter, referred to an L' direction). Further, the insulated housing 31 is provided thereon with a plurality of conductive contacts 34 each formed by means of bending a resilient metallic strip member. The conductive contacts 34 are arranged in the L' direction on the insulated housing 31. One of end portions of each of the conductive contacts 34 projecting from the insulated housing 31 toward the outside thereof constitutes a connecting terminal operative to be electrically connected with the electric circuit portion provided on the solid printed circuit board on which the mating electrical connector 30 is fixed. The other of the end portions of each of the conductive contacts 34 is located in the connectively engaging opening 33 to constitute a connecting portion, with which a corresponding one of the contacting terminals of the conductive contacts 18 arranged on the connectively engaging protrusion 17 of the electrical connector 11 comes into contact when the connectively engaging protrusion 17 of the electrical connector 11 is engaged with the connectively engaging opening 33.

Engaging apertures 36*a* and 36*b* are provided respectively on end portions 35*a* and 35*b* in the L' direction of the conductive shell 32. The engaging projections 16*c* and 16*d* provided on the conductive shell 16 of the electrical connector 11 are put in engagement respectively with the engaging apertures 36*a* and 36*b* when the connectively engaging protrusion 17 of the electrical connector 11 is engaged with the connectively engaging opening 33 provided on the insulated housing 31 and the conductive shell 32.

At the end portion 35*a* of the conductive shell 32, a contacting portion 37*a* with which the guiding member 22*a* provided on the aligning cover 13 engages when the connectively engaging protrusion 17 provided on the insulated housing 15 of the electrical connector 11 is put in engagement with the connectively engaging opening 33 provided on the insulated housing 31 and the conductive shell 32 and a contacting portion 38*a* with which the guiding member 23*a* provided on the aligning cover 13 engages when the connectively engaging protrusion 17 is put in engagement with the connectively engaging opening 33, are provided. Similarly, at the end portion 35*b* of the conductive shell 32, a contacting portion 37*b* with which the guiding member 22*b* provided on the aligning cover 13 engages when the connectively engaging protrusion 17 is put in engagement with the connectively engaging opening 33 and a contacting portion 38*b* with which the guiding member 23*b* provided on the aligning cover 13 engages when the connectively engaging protrusion 17 is put in engagement with the connectively engaging opening 33, are provided. The contacting portion 37*a* projects outwardly more than the contacting portion 38*a* in the L' direction and similarly the contacting portion 37*b* projects outwardly more than the contacting portion 38*b* in the U direction.

The end portions 35*a* and 35*b* of the conductive shell 32 constitute respectively a pair of end portions in the U direction of the mating electrical connector 30.

The conductive shell 32 is also provided with grounding terminals 39*a* and 39*b* which are located respectively at portions of the conductive shell 32 opposite to each other with conductive contacts 34 between. Each of the grounding terminals 39*a* and 39*b* extends from the insulated housing 31 to the outside thereof so as to be electrically connected with a grounding portion provided on the solid printed circuit board to which the mating electrical connector 30 is fixed.

The mating electrical connector 30 thus comprising the insulated housing 31 and the conductive shell 32 is fixed to the solid printed circuit board to be electrically connected with the electric circuit portion provided thereon in such a manner that the connecting terminal at the end of each of the conductive contact 34 is electrically connected with a circuit pattern on the solid printed circuit board and the grounding terminals 39*a* and 39*b* are electrically connected with the grounding portion provided on the solid printed circuit board.

Figure 9:
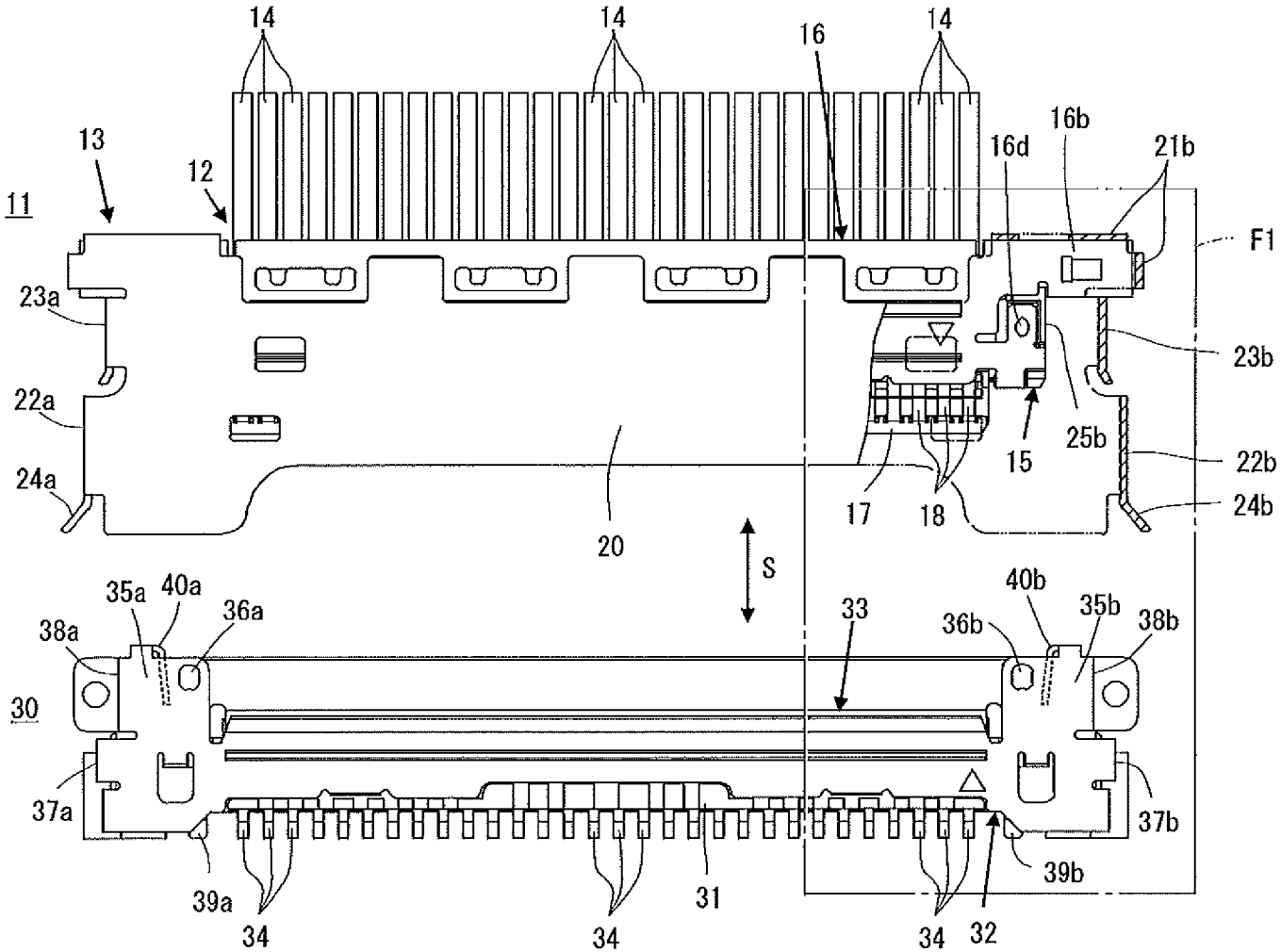
FIG. 9 is a schematic plan view showing the embodiment shown in FIGS. 2 and 3 and the example of mating electrical connector shown in FIGS. 7 and 8 opposite to each other.
Figure 10:
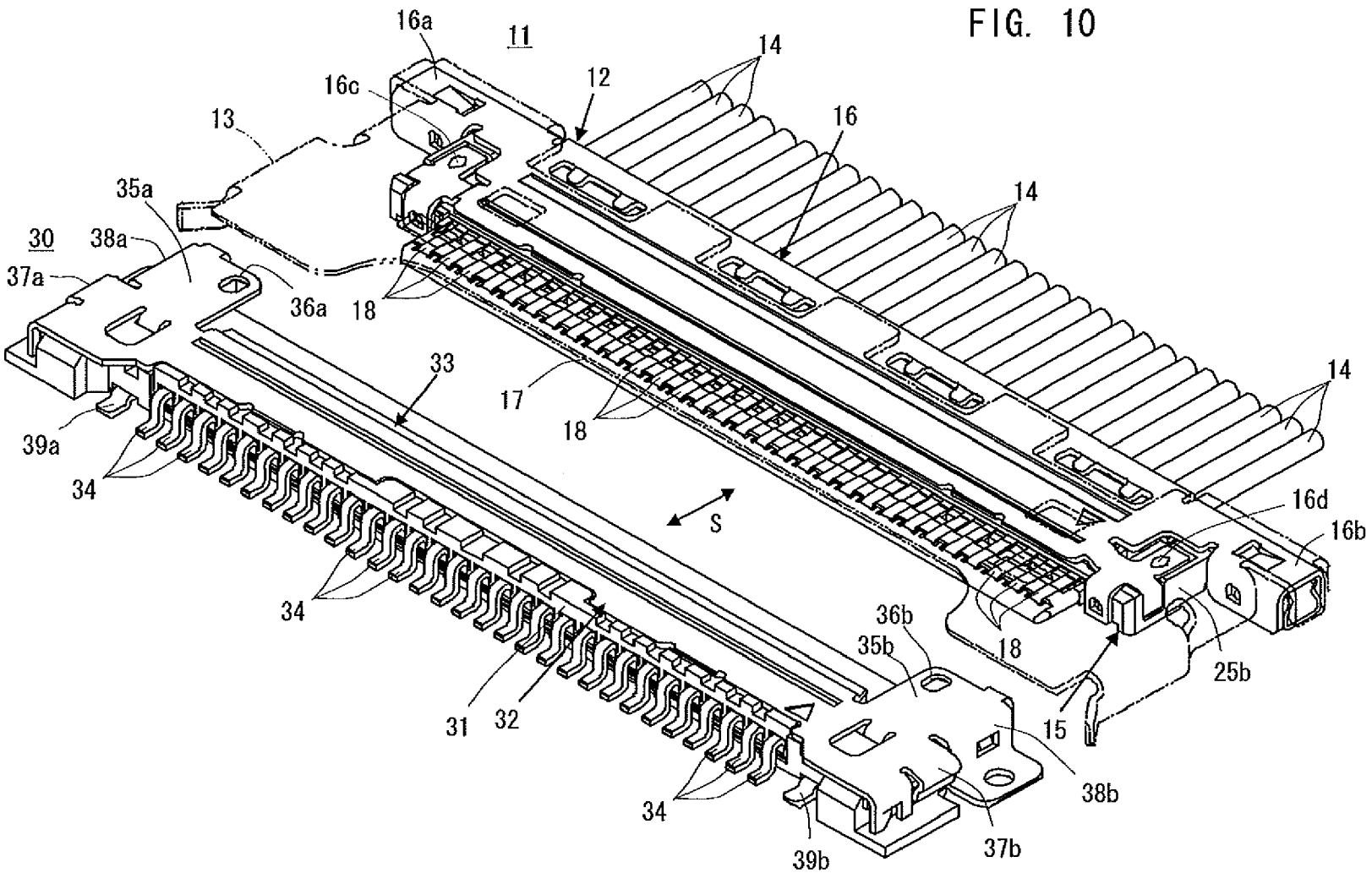
FIG. 10 is a schematic perspective view showing the embodiment shown in FIGS. 1 and 2 and the example of mating electrical connector shown in FIGS. 7 and 8 opposite to each other.

When the electrical connector 11 is put in engagement with the mating electrical connector 30 fixed to the solid printed circuit board so that the connectively engaging protrusion 17 provided on the insulated housing 31 of the electrical connector 11 is engaged with the connectively engaging opening 33 provided on the insulated housing 31 and the conductive shell 32 of the mating electrical connector 30 to be engaged with the same, prior to the engagement of the connectively engaging protrusion 17 with the connectively engaging opening 33, first the electrical connector 11 with which the coaxial cables 14 are connected is set to cause the connectively engaging protrusion 17 thereof to be opposite to the connectively engaging opening 33 of the mating electrical connector 30 in the S direction with a space between, as shown in FIGS. 9 and 10. For exposing the body 12 of the electrical connector 11 covered by the aligning cover 13, a part of the aligning cover 13 is removed in FIG. 9 and the aligning cover 13 is shown as a whole with imaginary lines in FIG. 10.

As shown in FIG. 9, the mating electrical connector 30 is provided with a resilient tongue 40*a* which extends from the end portion 35*a* of the conductive shell 32 to be bent toward the inside of the conductive shell 32 and a resilient tongue 40*b* which extends from the end portion 35*b* of the conductive shell 32 to be bent toward the inside of the conductive shell 32.

Figure 11:
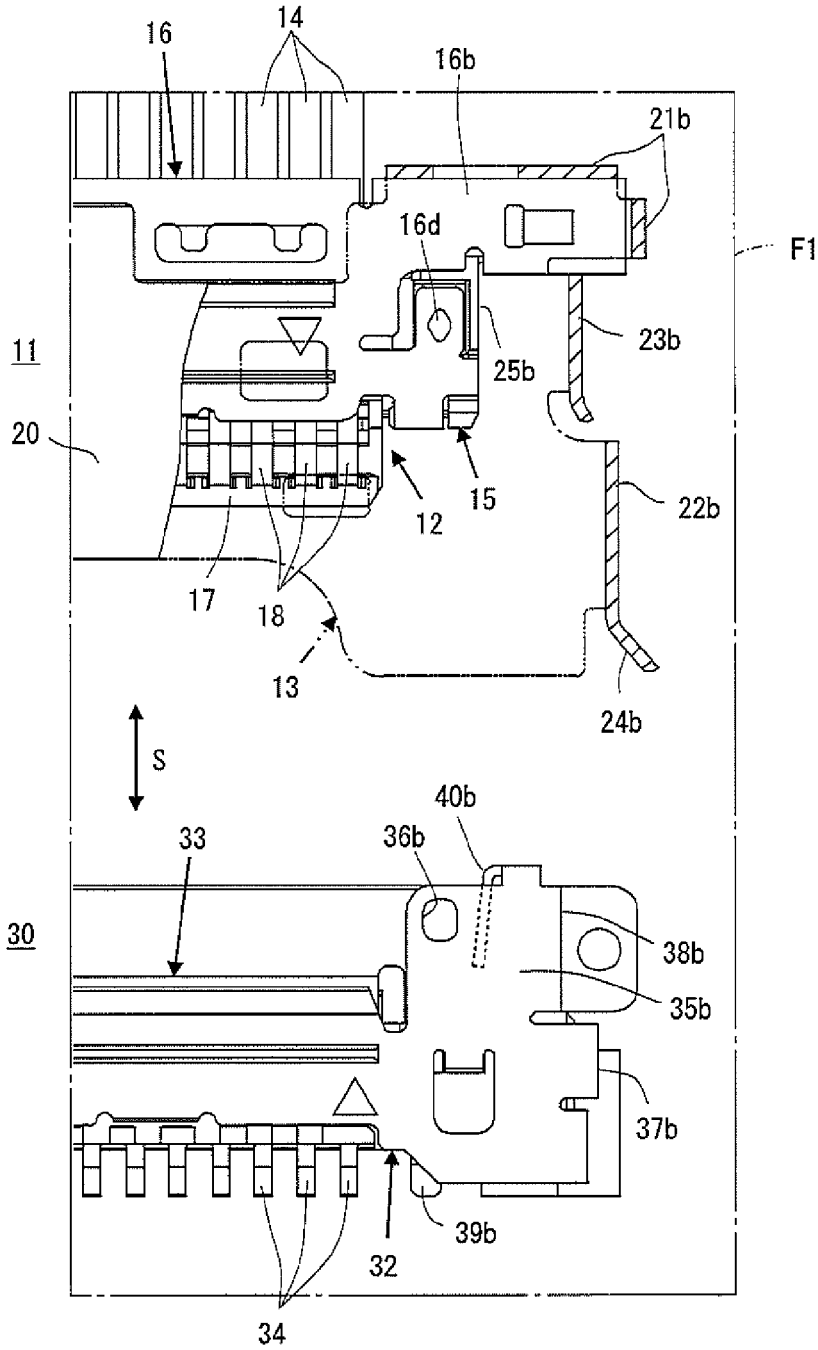
FIG. 11 is a schematic enlarged partial plan view showing portions of the embodiment and the example of mating electrical connector shown in a rectangular frame F1 in FIG. 9.

In such a situation as shown in FIGS. 9 and 10, as shown in FIG. 11 which shows enlarged portions of the electrical connector 11 and the mating electrical connector 30 shown in a rectangular frame F1 in FIG. 9, the guiding member 22*b* provided on the aligning cover 13 of the electrical connector 11 is positioned in the S direction to correspond to the contacting portion 37*b* provided at the end portion 35*b* of the conductive shell 32 of the mating electrical connector 30, and the guiding member 23*b* provided on the aligning cover 13 and the end surface 25*b* of the insulated housing 15 of the electrical connector 11 are positioned in the S direction to correspond respectively to the contacting portion 38*b* and the resilient tongue 40*b* provided at the end portion 35*b* of the conductive shell 32 of the mating electrical connector 30. Similarly, the guiding member 22*a* provided on the aligning cover 13 of the electrical connector 11 is positioned in the S direction to correspond to the contacting portion 37*a* provided at the end portion 35*a* of the conductive shell 32 of the mating electrical connector 30, and the guiding member 23*a* provided on the aligning cover 13 and the end surface 25*a* of the insulated housing 15 of the electrical connector 11 are positioned in the S direction to correspond respectively to the contacting portion 38*a* and the resilient tongue 40*a* provided at the end portion 35*a* of the conductive shell 32 of the mating electrical connector 30.

Figure 12:
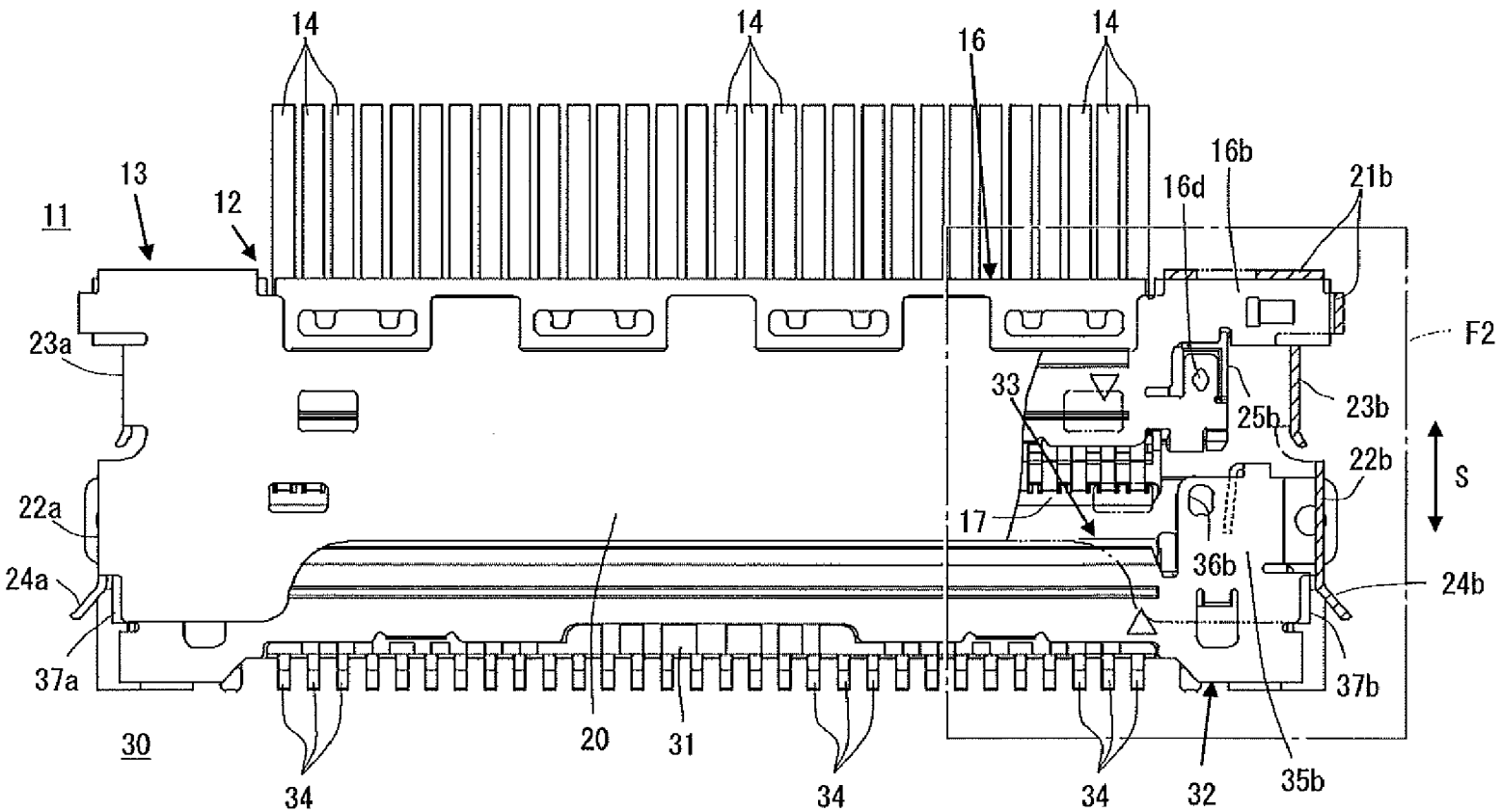
FIG. 12 is a schematic plan view showing a situation wherein the embodiment shown in FIGS. 1 and 2 is put at the start of engagement with the example of mating electrical connector shown in FIGS. 7 and 8.
Figure 13:
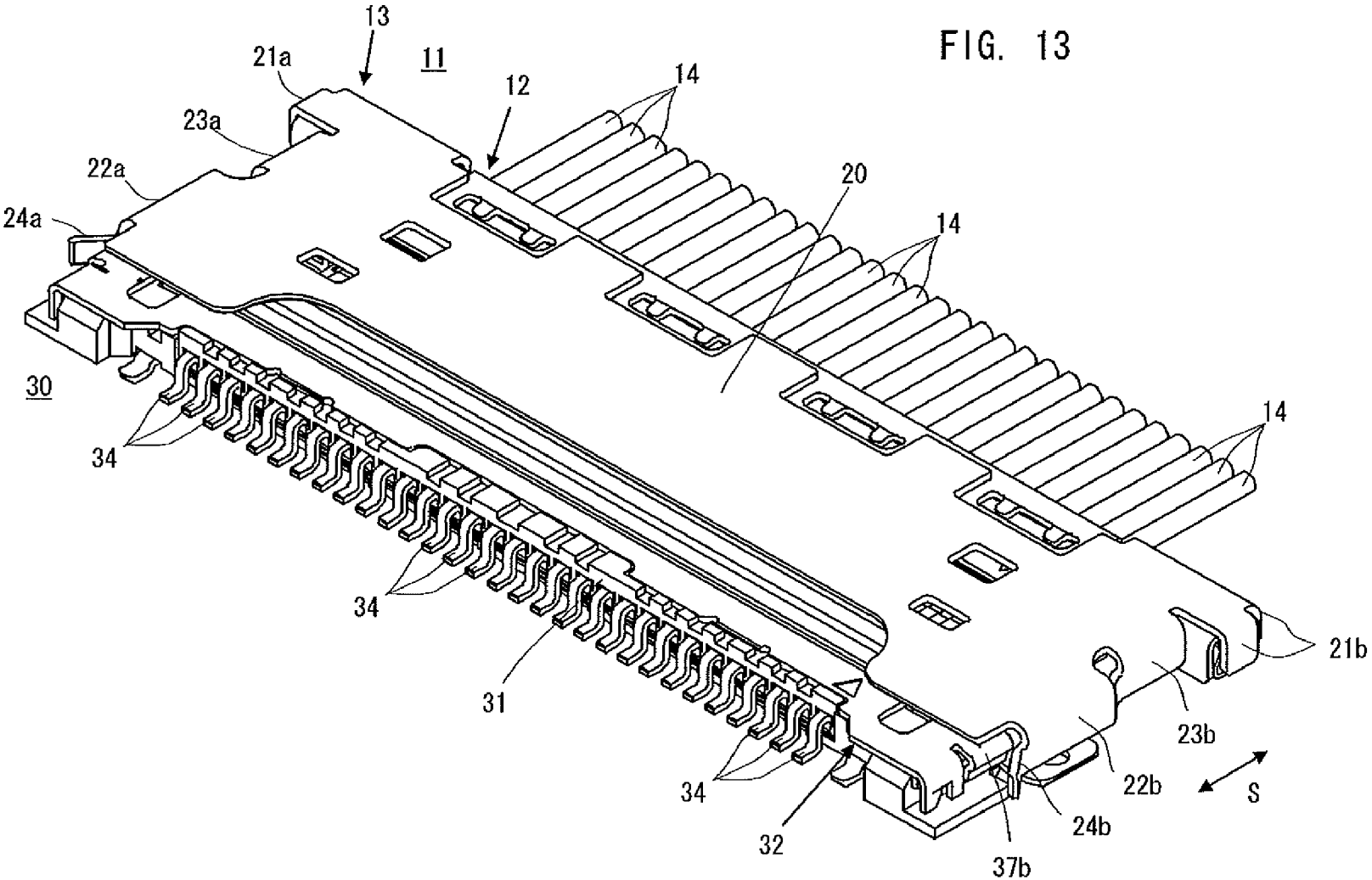
FIG. 13 is a schematic perspective view showing the situation wherein the embodiment shown in FIGS. 1 and 2 is put at the start of engagement with the example of mating electrical connector shown in FIGS. 7 and 8.
Figure 14:
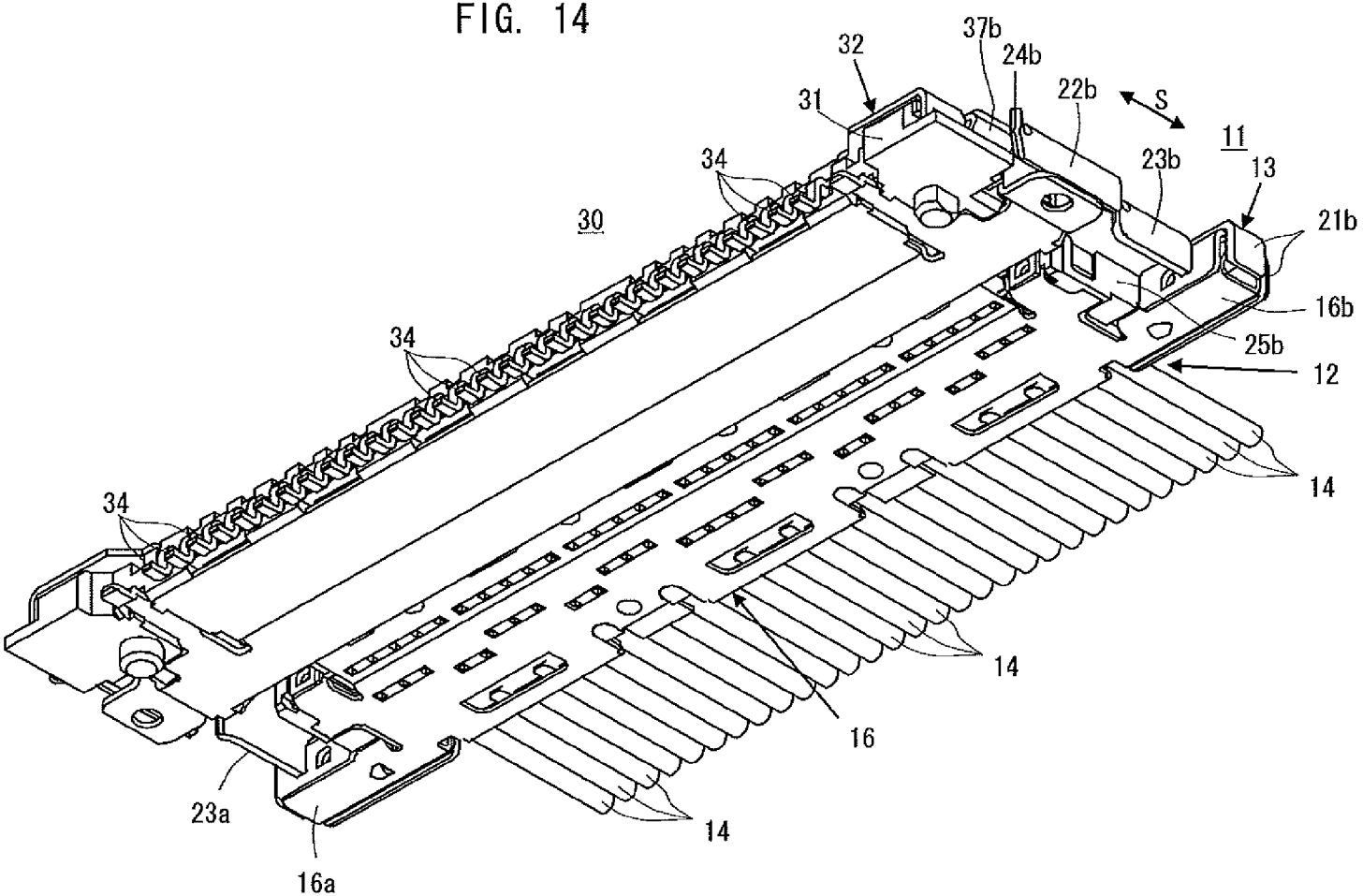
FIG. 14 is a schematic perspective view showing the situation wherein the embodiment shown in FIGS. 1 and 2 is put at the start of engagement with the example of mating electrical connector shown in FIGS. 7 and 8.
Figure 15:
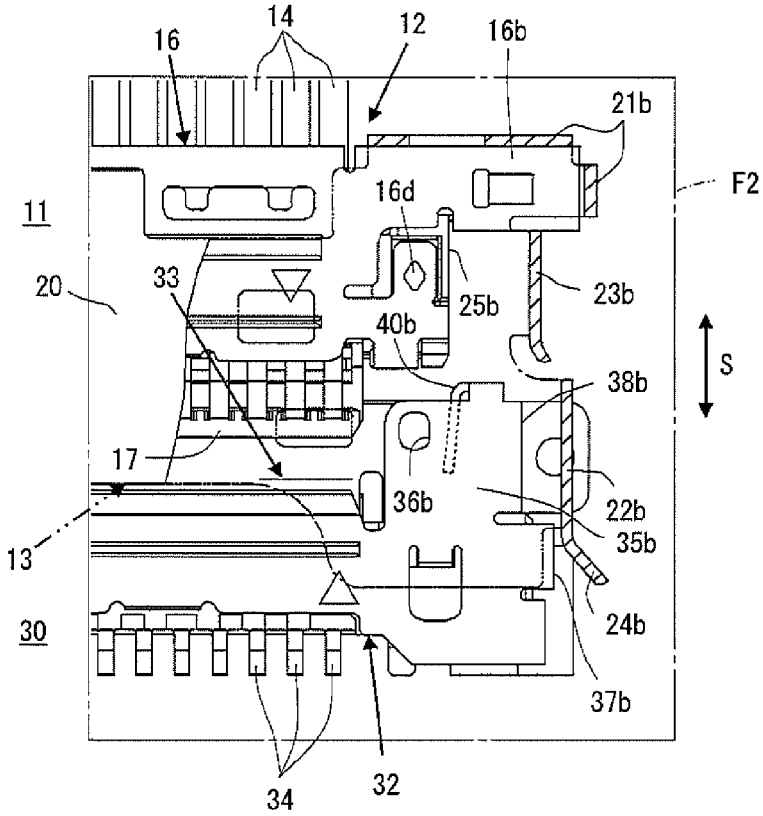
FIG. 15 is a schematic enlarged partial plan view showing portions of the embodiment and the example of mating electrical connector shown in a rectangular frame F2 in FIG. 12.

Next, the electrical connector 11 is moved in the S direction to the mating electrical connector 30 so that the guiding members 22*a* and 22*b* provided on the aligning cover 13 of the electrical connector 11 come respectively to engagement with the contacting portions 37*a* and 38*a* provided respectively at the end portions 35*a* and 35*b* of the conductive shell 32 of the mating electrical connector 30, as shown in FIGS. 12 to 14 and FIG. 15 which shows enlarged portions of the electrical connector 11 and the mating electrical connector 30 shown in a rectangular frame F2 in FIG. 12. For exposing the body 12 of the electrical connector 11 covered by the aligning cover 13, a part of the aligning cover 13 is removed in FIG. 12. On that occasion, since the end portion of the guiding member 22*a* forms the engagement guiding portion 24*a* which is bent outwardly to have the slanted surface in the L direction and the end portion of the guiding member 22*b* forms the engagement guiding portion 24*b* which is bent outwardly to have a slanted surface in the L direction, the guiding members 22*a* and 22*b* are guided to the contacting portions 37*a* and 37*b* respectively by the engagement guiding portions 24*a* and 24*b* and thereby a situation wherein the guiding members 22*a* and 22*b* come to engagement with the contacting portions 37*a* and 37*b* is obtained easily and smoothly.

In such a manner as mentioned above, the guiding members 22*a* and 22*b* put in engagement with the contacting portions 37*a* and 38*a* are operative to restrain the insulated housing 15 of the electrical connector 11 in its position and moving direction so as to be aligned with the mating electrical connector 30 in the S direction and the electrical connector 11 is guided to move along the S direction. In the condition shown in FIGS. 12 to 15, the connectively engaging protrusion 17 provided on the insulated housing 15 of the electrical connector 11 has not reached yet to the connectively engaging opening 33 provided on the insulated housing 31 and the conductive shell 32 of the mating electrical connector 30.

Figure 18:
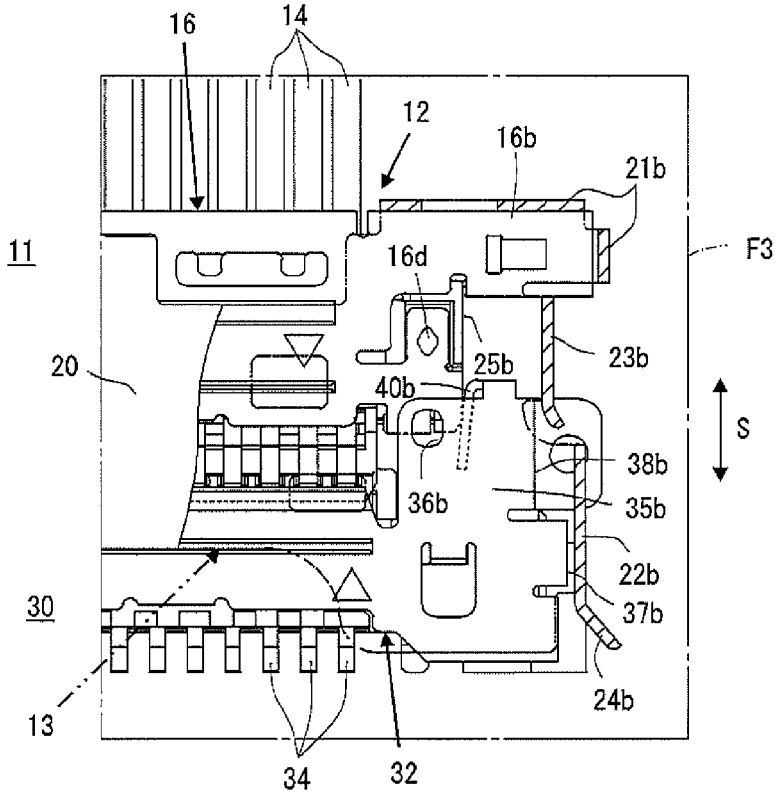
FIG. 18 is a schematic enlarged partial plan view showing portions of the embodiment and the example of mating electrical connector shown in a rectangular frame F3 in FIG. 16.
Figure 16:
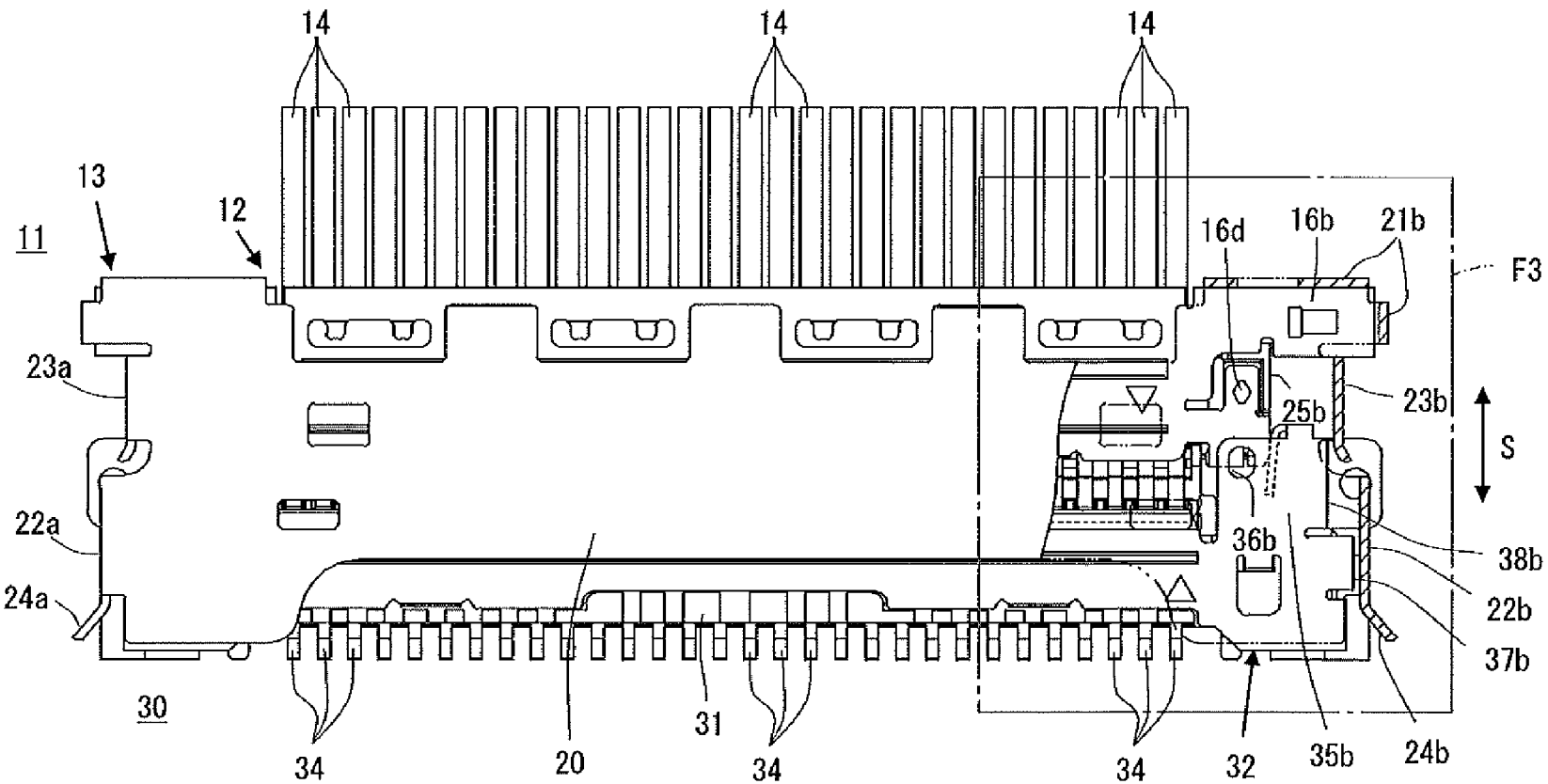
FIG. 16 is a schematic plan view showing a situation wherein the embodiment shown in FIGS. 1 and 2 is in process of engagement with the example of mating electrical connector shown in FIGS. 7 and 8.
Figure 17:
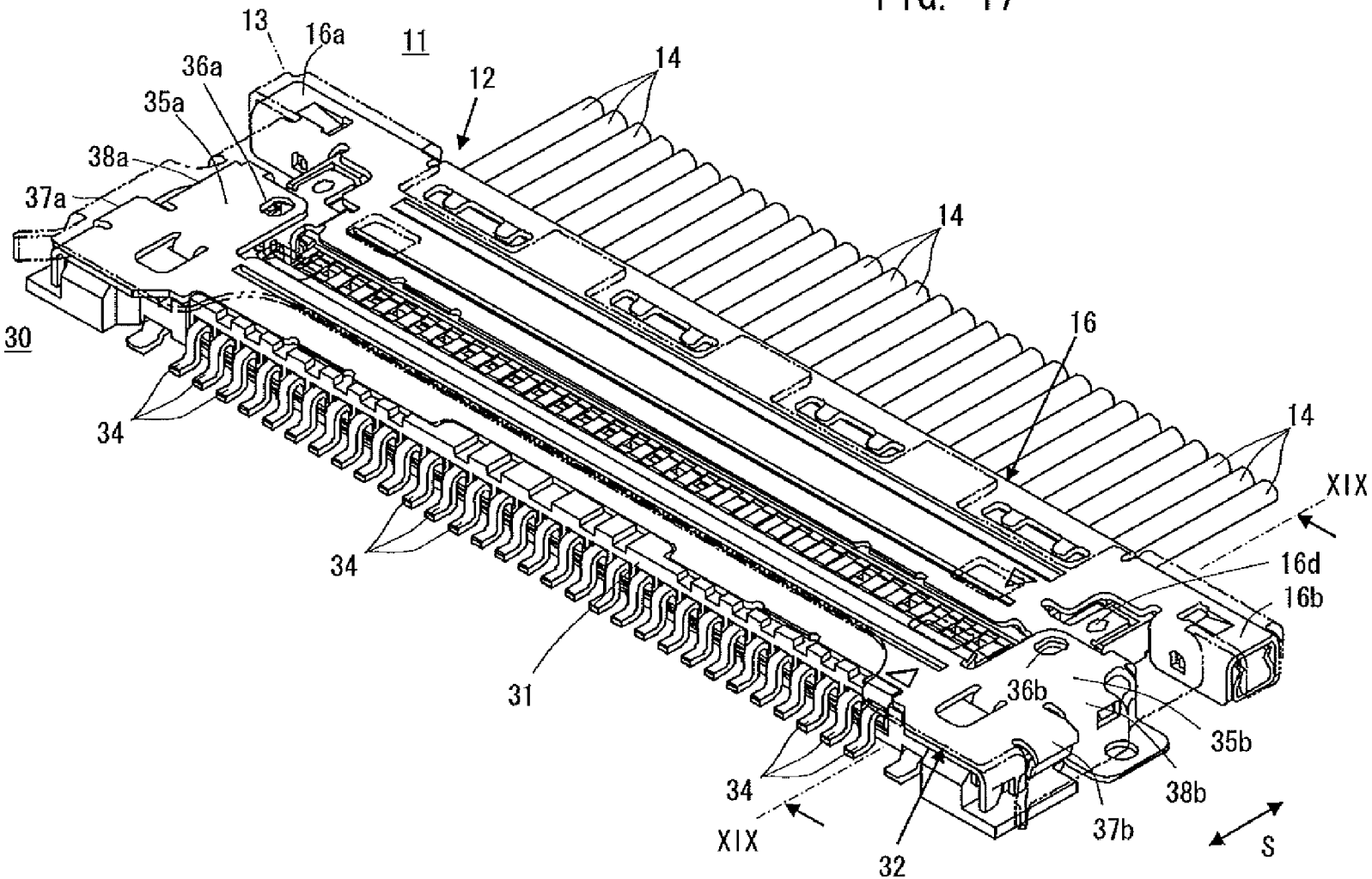
FIG. 17 is a schematic perspective view showing the situation wherein the embodiment shown in FIGS. 1 and 2 is in process of engagement with the example of mating electrical connector shown in FIGS. 7 and 8.

Then, the electrical connector 11 is further moved in the S direction toward the mating electrical connector 30 with the guiding members 22*a* and 22*b* provided on the aligning cover 13 which are put in engagement with the contacting portions 37*a* and 37*b* provided on the conductive shell 32 of the mating electrical connector 30, respectively. Thereby, as shown in FIGS. 16 and 17 and FIG. 18 which shows enlarged portions of the electrical connector 11 and the mating electrical connector 30 shown in a rectangular frame F3 in FIG. 16, the guiding members 22*a* and 22*b* are continuously put in engagement with the contacting portions 37*a* and 37*b* and the guiding members 23*a* and 23*b* provided on the aligning cover 13 of the electrical connector 11 come respectively to engagement with the contacting portions 38*a* and 38*b* provided respectively at the end portions 35*a* and 35*b* of the conductive shell 32 of the mating electrical connector 30. For exposing the body 12 of the electrical connector 11 covered by the aligning cover 13, a part of the aligning cover 13 is removed in FIG. 16 and the aligning cover 13 is shown as a whole with imaginary lines in FIG. 17. The guiding members 23*a* and 23*b* come respectively to engagement with the contacting portions 38*a* and 38*b* under the condition wherein the guiding members 22*a* and 22*b* are continuously put in engagement with the contacting portions 37*a* and 37*b* and thereby the insulated housing 15 of the electrical connector 11 is restrained in its position and moving direction so as to be aligned with the mating electrical connector 30 in the S direction and guided to move along the S direction. Therefore, a situation wherein the guiding members 23*a* and 23*b* come to engagement with the contacting portions 38*a* and 38*b* is obtained easily and smoothly.

Figure 19:
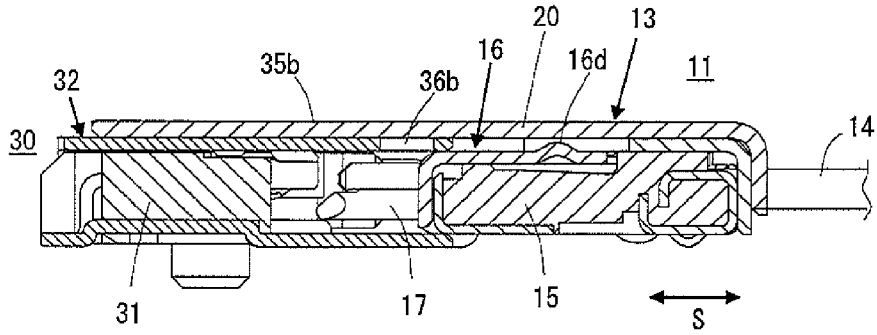
FIG. 19 is a schematic cross sectional view taken along line XIX-XIX in FIG. 17.

On that occasion, as shown in FIG. 19 which shows a cross section taken along line XIX-XIX in FIG. 17, a port of the end portion 35*b* of the conductive shell 32 of the mating electrical connector 30, in which the engaging aperture 36*b* is formed, is put between a part of the conductive shell 16 of the electrical connector 11, in which the engaging projection 16*d* is formed, and an end portion of the flat plate portion 20 of the aligning cover 13, in a direction perpendicular to each of the L and S directions. Similarly, a port of the end portion 35*a* of the conductive shell 32 of the mating electrical connector 30, in which the engaging aperture 36*a* is formed, is put between a part of the conductive shell 16 of the electrical connector 11, in which the engaging projection 16*c* is formed, and an end portion of the flat plate portion 20 of the aligning cover 13, in the direction perpendicular to each of the L and S directions.

In the condition shown in FIGS. 16 to 19 also, the connectively engaging protrusion 17 provided on the insulated housing 15 of the electrical connector 11 has not reached yet to the connectively engaging opening 33 provided on the insulated housing 31 and the conductive shell 32 of the mating electrical connector 30.

After that, the electrical connector 11 is still further moved in the S direction toward the mating electrical connector 30 with the guiding members 22*a* and 22*b* provided on the aligning cover 13 which are put in engagement with the contacting portions 37*a* and 37*b* provided on the conductive shell 32 of the mating electrical connector 30, respectively, and the guiding members 23*a* and 23*b* provided on the aligning cover 13 which are put in engagement with the contacting portions 38*a* and 38*b* provided on the conductive shell 32 of the mating electrical connector 30, respectively.

Figure 23:
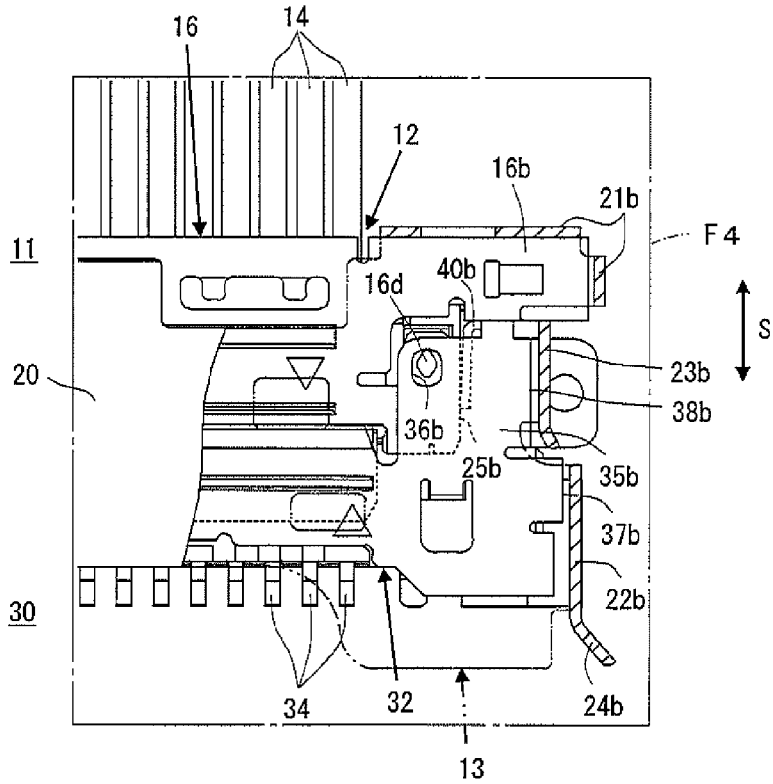
FIG. 23 is a schematic enlarged partial plan view showing portions of the embodiment and the example of mating electrical connector shown in a rectangular frame F4 in FIG. 20.
Figure 20:
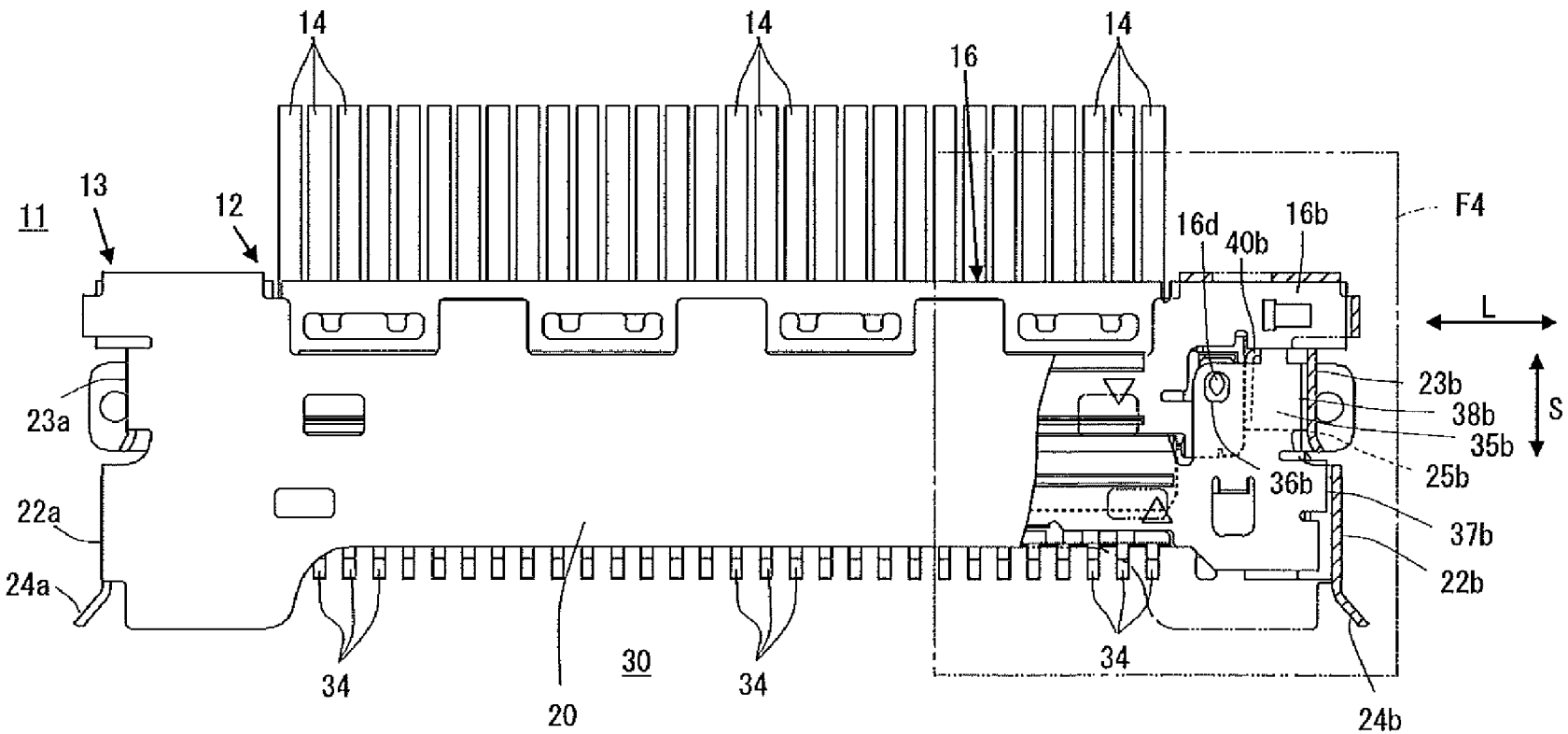
FIG. 20 is a schematic plan view showing a situation wherein the embodiment shown in FIGS. 1 and 2 is completely engaged with the example of mating electrical connector shown in FIGS. 7 and 8.
Figure 21:
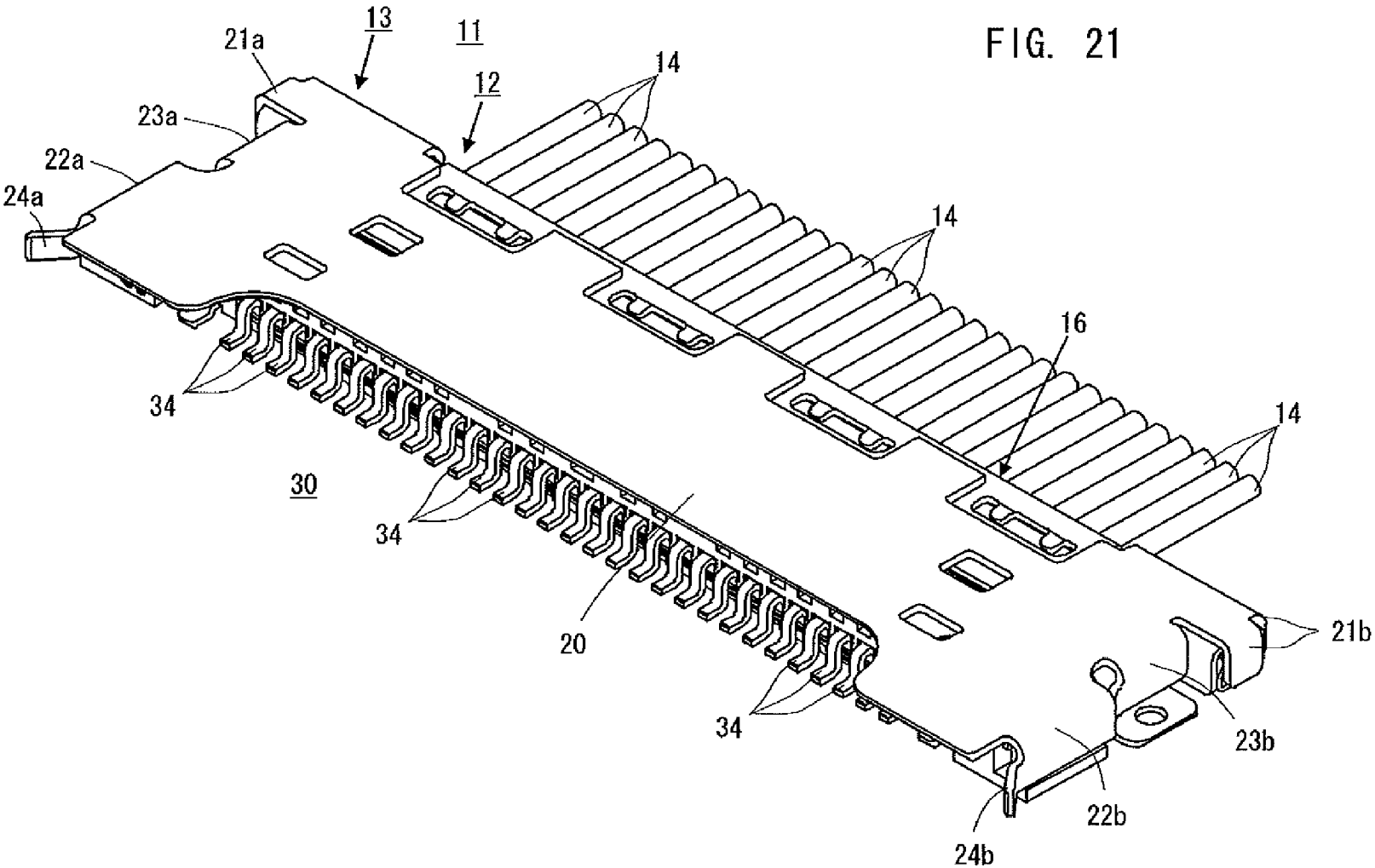
FIG. 21 is a schematic perspective view showing the situation wherein the embodiment shown in FIGS. 1 and 2 is completely engaged with the example of mating electrical connector shown in FIGS. 7 and 8.

Thereby, as shown in FIGS. 20 to 22 and FIG. 23 which shows enlarged portions of the electrical connector 11 and the mating electrical connector 30 shown in a rectangular frame F4 in FIG. 20, the guiding members 22*a* and 22*b* are continuously put in engagement with the contacting portions 37*a* and 37*b*, the guiding members 23*a* and 23*b* are continuously put in engagement with the contacting portions 38*a* and 38*b*, a part of the end portion 35*b* of the conductive shell 32 of the mating electrical connector 30, in which the contacting portion 38*b* and the resilient tongue 40*b* are formed, is put between the end surface 25*b* of the insulated housing 15 of the electrical connector 11 and the guiding member 23*b* facing the end surface 25*b*, as shown in FIGS. 20 and 23, and a part of the end portion 35*a* of the conductive shell 32 of the mating electrical connector 30, in which the contacting portion 38*a* and the resilient tongue 40*a* are formed, is put between the end surface 25*a* of the insulated housing 15 of the electrical connector 11 and the guiding member 23*a* facing the end surface 25*a*. Under such a condition, the electrical connector 11 is moved along the S direction until the end portions 16*a* and 16*b* of the conductive shell 16 of the electrical connector 11 come into contact respectively with ports of the end portions 35*a* and 35*b* of the conductive shell 32 of the mating electrical connector 30, in which the resilient tongues 40*a* and 40*b* are formed, respectively.

Figure 22:
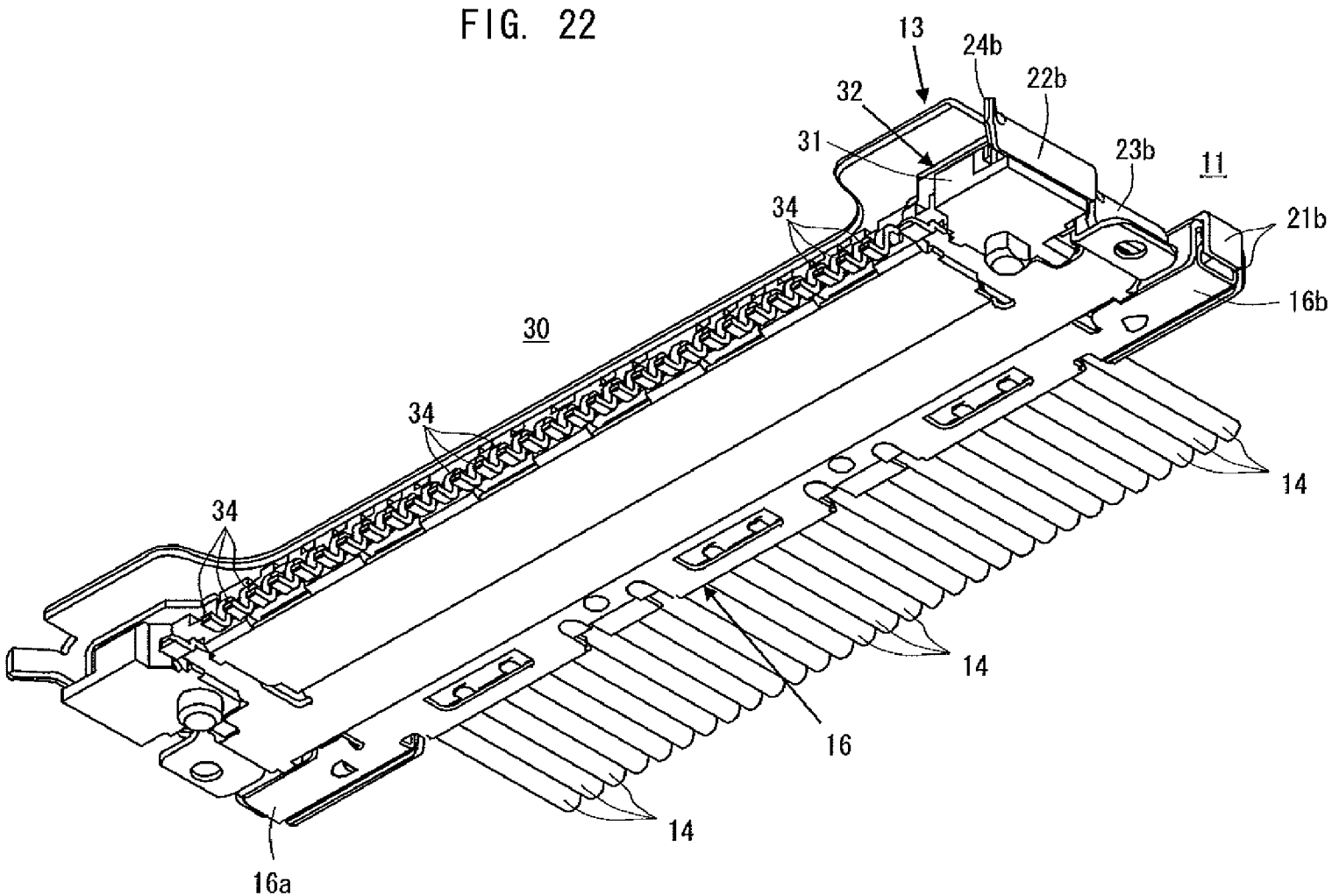
FIG. 22 is a schematic perspective view showing the situation wherein the embodiment shown in FIGS. 1 and 2 is completely engaged with the example of mating electrical connector shown in FIGS. 7 and 8.

Then, as shown in FIGS. 20, 22 and 23, the engaging projections 16*c* and 16*d* provided on the conductive shell 16 of the electrical connector 11 engage respectively with the engaging apertures 36*a* and 36*b* formed respectively at the end portions 35*a* and 35*b* of the conductive shell 32 of the mating electrical connector 30 when the end portions 16*a* and 16*b* of the conductive shell 16 of the electrical connector 11 come into contact respectively with ports of the end portions 35*a* and 35*b* of the conductive shell 32 of the mating electrical connector 30, in which the resilient tongues 40*a* and 40*b* are formed, respectively, and thereby the movement of the electrical connector 11 in the S direction is finished.

When the engaging projections 16*c* and 16*d* provided on the conductive shell 16 of the electrical connector 11 are put in engagement with the engaging apertures 36*a* and 36*b* formed respectively at the end portions 35*a* and 35*b* of the conductive shell 32 of the mating electrical connector 30 in such a manner as described above, the connectively engaging protrusion 17 provided on the insulated housing 15 of the electrical connector 11 has reached to the connectively engaging opening 33 provided on the insulated housing 31 and the conductive shell 32 of the mating electrical connector 30 to be engaged with the same.

Such an engagement of the connectively engaging protrusion 17 with the connectively engaging opening 33 as mentioned above is carried out by moving the electrical connector 11 to the mating electrical connector 30 in the S direction under the condition wherein the guiding members 22*a* and 22*b* are put in engagement with the contacting portions 37*a* and 37*b*, the guiding members 23*a* and 23*b* are put in engagement with the contacting portions 38*a* and 38*b*, the part of the end portion 35*b* of the conductive shell 32 of the mating electrical connector 30, in which the contacting portion 38*b* and the resilient tongue 40*b* are formed, is put between the end surface 25*b* of the insulated housing 15 of the electrical connector 11 and the guiding member 23*b* facing the end surface 25*b*, and the part of the end portion 35*a* of the conductive shell 32 of the mating electrical connector 30, in which the contacting portion 38*a* and the resilient tongue 40*a* are formed, is put between the end surface 25*a* of the insulated housing 15 of the electrical connector 11 and the guiding member 23*a* facing the end surface 25*a*. In other words, the engagement of the connectively engaging protrusion 17 with the connectively engaging opening 33 is carried out by moving the electrical connector 11 to the mating electrical connector 30 in the S direction under the condition wherein the electrical connector 11 is restrained in its position and moving direction so as to be aligned with the mating electrical connector 30 in the S direction and guided to move along the S direction by the aligning cover 13 which has the guiding members 22*a* and 22*b* put in engagement with the contacting portions 37*a* and 37*b* and the guiding members 23*a* and 23*b* put in engagement with the contacting portions 38*a* and 38*b*. Accordingly, a situation wherein the engagement of the connectively engaging protrusion 17 with the connectively engaging opening 33 is carried out appropriately and smoothly can be obtained easily and smoothly.

Further, when the engaging projections 16*c* and 16*d* provided on the conductive shell 16 of the electrical connector 11 engage respectively with the engaging apertures 36*a* and 36*b* formed respectively at the end portions 35*a* and 35*b* of the conductive shell 32 of the mating electrical connector 30, the part of the conductive shell 16 in which the engaging projection 16*d* is formed has been moved in the S direction from the position shown in FIG. 19 toward the mating electrical connector 30 and the part of the end portion 35*b* of the conductive shell 32 in which the engaging aperture 36*b* is formed has been put between the part of the conductive shell 16 in which the engaging projection 16*d* is formed and the end portion of the flat plate portion 20 of the aligning cover 13 in the direction perpendicular to each of the L and S directions. Similarly, the part of the end portion 35*a* of the conductive shell 32 in which the engaging aperture 36*a* is formed has been put between the part of the conductive shell 16 in which the engaging projection 16*c* is formed and the end portion of the flat plate portion 20 of the aligning cover 13 in the direction perpendicular to each of the L and S directions.

With the part of the end portion 35*b* of the conductive shell 32 in which the engaging aperture 36*b* is formed and which is put between the part of the conductive shell 16 in which the engaging projection 16*d* is formed and the end portion of the flat plate portion 20 of the aligning cover 13 in the direction perpendicular to each of the L and S directions and the part of the end portion 35*a* of the conductive shell 32 in which the engaging aperture 36*a* is formed and which is put between the part of the conductive shell 16 in which the engaging projection 16*c* is formed and the end portion of the flat plate portion 20 of the aligning cover 13 in the direction perpendicular to each of the L and S directions, the electrical connector 11 is prevented from changing its posture in regard to the mating electrical connector 30 in the direction perpendicular to each of the L and S directions, so that the electrical connector 11 and the mating electrical connector 30 are maintained in stable mutual engagement.

Then, when the connectively engaging protrusion 17 provided on the insulated housing 15 of the electrical connector 11 is caused to get out of the connectively engaging opening 33 provided on the insulated housing 31 and the conductive shell 32 of the mating electrical connector 30 so as to release the electrical connector 11 from the engagement with the mating electrical connector 30, the electrical connector 11 having the connectively engaging protrusion 17 engaged with the connectively engaging opening 33 is moved in the S direction to go away from the mating electrical connector 30. On that occasion, since the part of the end portion 35*b* of the conductive shell 32 in which the engaging aperture 36*b* is formed is put between the part of the conductive shell 16 in which the engaging projection 16*d* is formed and the end portion of the flat plate portion 20 of the aligning cover 13 in the direction perpendicular to each of the L and S directions and the part of the end portion 35*a* of the conductive shell 32 in which the engaging aperture 36*a* is formed is put between the part of the conductive shell 16 in which the engaging projection 16*c* is formed and the end portion of the flat plate portion 20 of the aligning cover 13 in the direction perpendicular to each of the L and S directions, the electrical connector 11 is prevented from shifting to the mating electrical connector 30 in the direction perpendicular to each of the L and S directions and the connectively engaging protrusion 17 is caused to get out of the connectively engaging opening 33 in the S direction without swinging undesirably. Further, when the connectively engaging protrusion 17 is caused to get out of the connectively engaging opening 33, since the part of the end portion 35*b* of the conductive shell 32 in which the contacting portion 38*b* and the resilient tongue 40*b* are formed is put between the end surface 25*b* of the insulated housing 15 of the electrical connector 11 and the guiding member 23*b* facing the end surface 25*b* and the part of the end portion 35*a* of the conductive shell 32 in which the contacting portion 38*a* and the resilient tongue 40*a* are formed is put between the end surface 25*a* of the insulated housing 15 of the electrical connector 11 and the guiding member 23*a* facing the end surface 25*a*, the electrical connector 11 is prevented from shifting to the mating electrical connector 30 in the L direction and therefore the connectively engaging protrusion 17 is caused to get out of the connectively engaging opening 33 in the S direction also without swinging undesirably.

After that, the electrical connector 11 is further moved to go way from the mating electrical connector 30 in the S direction under the guidance by the aligning cover 13 which has the guiding members 22*a* and 22*b* put in engagement with the contacting portions 37*a* and 37*b* and the guiding members 23*a* and 23*b* put in engagement with the contacting portions 38*a* and 38*b*. Thereby, a situation wherein the electrical connector 11 is caused to go away from the mating electrical connector 30 appropriately and smoothly can be obtained easily and smoothly.

Although, in the electrical connector 11 described above, the aligning cover 13 is attached to the conductive shell 16 constituting the body 12 together with the insulated housing 15, for example, to be fixed by soldering, it is also possible that the aligning cover 13 is attached to the conductive shell 16 to be detachable from the same.

APPLICABILITY FOR INDUSTRIAL USE

As apparent from the above description, the electrical connector according to the present invention can be applied widely to various kinds of electronic apparatus or the like as an electrical connector which is operative to cause a plurality of contacting terminals of conductive contacts which are arranged on a connectively engaging protrusion provided on an insulated housing to be connected respectively with a plurality of conductive contacts provided in a mating electrical connector and with which the connectively engaging protrusion is put in engagement with a connectively engaging opening of the mating electrical connector appropriately and smoothly.

The invention claimed is:

1. An electrical connector comprising;

an insulated housing on which a first engaging portion is provided for engaging with a second engaging portion provided in a mating electrical connector, a plurality of first conductive contacts provided on the insulated housing with contacting terminals thereof arranged along a predetermined direction on the first engaging portion and operative to come into contact with a plurality of second conductive contacts provided in the mating electrical connector when the first engaging portion is put in engagement with the second engaging portion, a conductive shell for covering partially the insulated housing, and an aligning cover attached to the conductive shell for covering partially an outside surface of the conductive shell and operative to cause a pair of end portions thereof in the predetermined direction to engage respectively with a pair of end portions in the predetermined direction of the mating electrical connector for aligning the insulated housing with the mating electrical connector to be restricted in position and moving direction when the first engaging portion is engaged with the second engaging portion, wherein each of said end portions of the aligning cover is provided with a first guiding member facing an end surface of the insulated housing in the predetermined direction with a predetermined space between and a second guiding member apart from the first guiding member on the side of the first engaging portion, and each of the first and second guiding members is operative to engage with said end portion of the mating electrical connector when the first engaging portion is engaged with the second engaging portion.

2. An electrical connector according to claim 1, wherein each of the first and second guiding members provided on each of said end portions of the aligning cover extends to be bent from a portion of the aligning cover expanding over the outside surface of the conductive shell to approach said end surface of the insulated housing.

3. An electrical connector according to claim 1, wherein, when the first engaging portion is put in engagement with the second engaging portion, first the second guiding member comes to engagement with a first contacting portion provided at said end portion of the mating electrical connector for guiding the insulated housing and then the first guiding member comes to engagement with a second contacting portion provided at said end portion of the mating electrical connector to face said end surface of the insulated housing with the second contacting portion between in the predetermined direction for guiding further the insulated housing so that an engagement of the first engaging portion with the second engaging portion is completed.

4. An electrical connector comprising;

an insulated housing on which a first engaging portion is provided for engaging with a second engaging portion provided in a mating electrical connector, a plurality of first conductive contacts provided on the insulated housing with contacting terminals thereof arranged along a predetermined direction on the first engaging portion and operative to come into contact with a plurality of second conductive contacts provided in the mating electrical connector when the first engaging portion is put in engagement with the second engaging portion, a conductive shell for covering partially the insulated housing, and an aligning cover attached to the conductive shell for covering partially an outside surface of the conductive shell and operative to cause a pair of end portions thereof in the predetermined direction to engage respectively with a pair of end portions in the predetermined direction of the mating electrical connector for aligning the insulated housing with the mating electrical connector to be restricted in position and moving direction when the first engaging portion is engaged with the second engaging portion, wherein each of said end portions of the aligning cover faces an outside surface of the conductive shell with a part of said end portion of the mating electrical connector between in a direction perpendicular to the predetermined direction when the engagement of the first engaging portion with the second engaging portion is completed.

5. An electrical connector according to claim 4, wherein each of said end portions of the aligning cover and the outside surface of the conductive shell face each other with a part of a conductive shell constituting the part of said end portion of the mating electrical connector between when the engagement of the first engaging portion with the second engaging portion is completed.

* * * * *